US011573050B2

(12) United States Patent
Lee

(10) Patent No.: US 11,573,050 B2
(45) Date of Patent: Feb. 7, 2023

(54) REFRIGERATOR

(71) Applicant: LG ELECTRONICS INC., Seoul (KR)

(72) Inventor: Sunghun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/285,402

(22) PCT Filed: Oct. 17, 2019

(86) PCT No.: PCT/KR2019/013634
§ 371 (c)(1),
(2) Date: Apr. 14, 2021

(87) PCT Pub. No.: WO2020/080841
PCT Pub. Date: Apr. 23, 2020

(65) Prior Publication Data

US 2021/0396460 A1 Dec. 23, 2021

(30) Foreign Application Priority Data

Oct. 19, 2018 (KR) ..... 10-2018-0125328

(51) Int. Cl.
*F25D 25/02* (2006.01)
*A47B 88/90* (2017.01)
*A47B 88/457* (2017.01)

(52) U.S. Cl.
CPC ..... *F25D 25/025* (2013.01); *A47B 88/457* (2017.01); *A47B 88/90* (2017.01); *A47B 2088/901* (2017.01)

(58) Field of Classification Search
CPC ..... F25D 25/025; A47B 2088/901; A47B 88/457; A47B 88/90
See application file for complete search history.

(56) References Cited

U.S. PATENT DOCUMENTS 7,628,461 B2 * 12/2009 Carden ..... F25D 25/04 312/402
9,377,238 B2 6/2016 Hall et al.
10,465,970 B1 * 11/2019 Kang ..... F25D 25/025
(Continued)

FOREIGN PATENT DOCUMENTS

CN 2548990 Y 5/2003
CN 1727829 A 2/2006
(Continued)

*Primary Examiner* — Daniel J Rohrhoff
(74) *Attorney, Agent, or Firm* — Dentons US LLP

(57) ABSTRACT

A refrigerator includes: a cabinet having a storage space; a door including a door unit configured to open or close the storage space and a drawer unit to provide a receiving space; a driving device disposed at the door unit and including a driving motor to provide power; and an elevation device disposed at the drawer unit, connected with the driving device, and configured to move up or down, the elevation device includes: a lower frame; an upper frame positioned over the lower frame; a scissor assembly configured to connect the lower frame and the upper frame; and a screw rotatably supported on the lower frame, configured to be rotated by driving force transmitted from the driving device disposed at the door unit, and connected with the scissor assembly.

20 Claims, 20 Drawing Sheets

(56) References Cited

U.S. PATENT DOCUMENTS

| | | | | |
|---|---|---|---|---|
| 10,598,426 | B2 * | 3/2020 | Kang | F25D 25/025 |
| 10,939,758 | B2 * | 3/2021 | Kim | A47B 88/90 |
| 11,248,837 | B2 * | 2/2022 | Choi | F25D 11/02 |
| 11,255,601 | B2 * | 2/2022 | Choi | A47B 88/90 |
| 2006/0043848 | A1 * | 3/2006 | Jeong | A47B 67/04 312/310 |
| 2006/0207283 | A1 * | 9/2006 | Kim | F25D 25/025 62/407 |
| 2014/0265797 | A1 * | 9/2014 | Scheuring | F25D 25/025 312/405 |
| 2014/0265806 | A1 * | 9/2014 | Hall | F25D 25/025 312/408 |
| 2019/0162466 | A1 | 5/2019 | Yang et al. | |
| 2019/0293340 | A1 * | 9/2019 | Choi | F25D 25/025 |
| 2020/0208907 | A1 * | 7/2020 | Kim | F25D 25/025 |

FOREIGN PATENT DOCUMENTS

| | | | |
|---|---|---|---|
| KR | 20040059043 | A | 7/2004 |
| KR | 1020050090253 | A | 9/2005 |
| KR | 20170140010 | A | 12/2017 |
| KR | 20180064761 | A | 6/2018 |

* cited by examiner

【Figure 1】
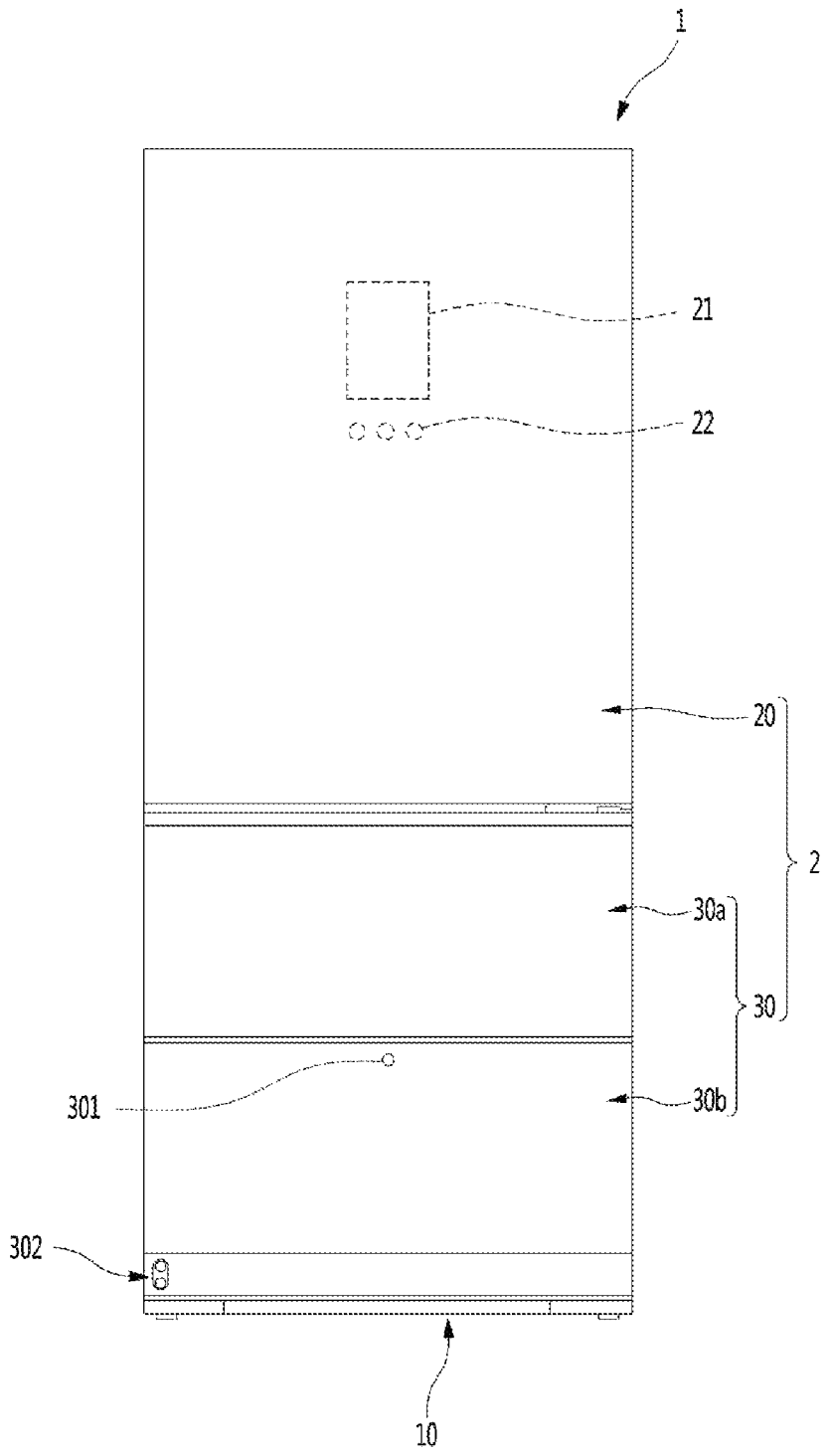

【Figure 2】
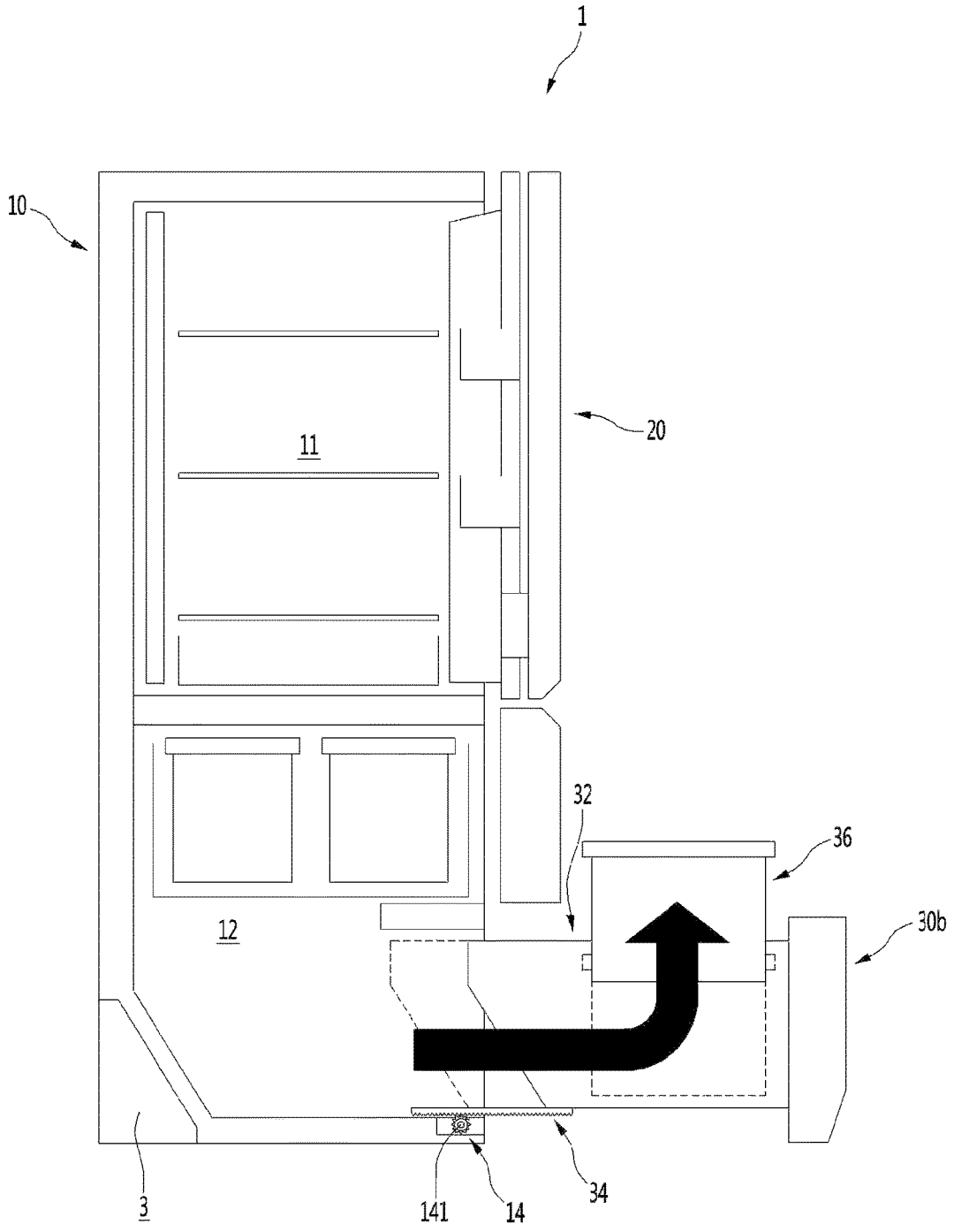

【Figure 3】
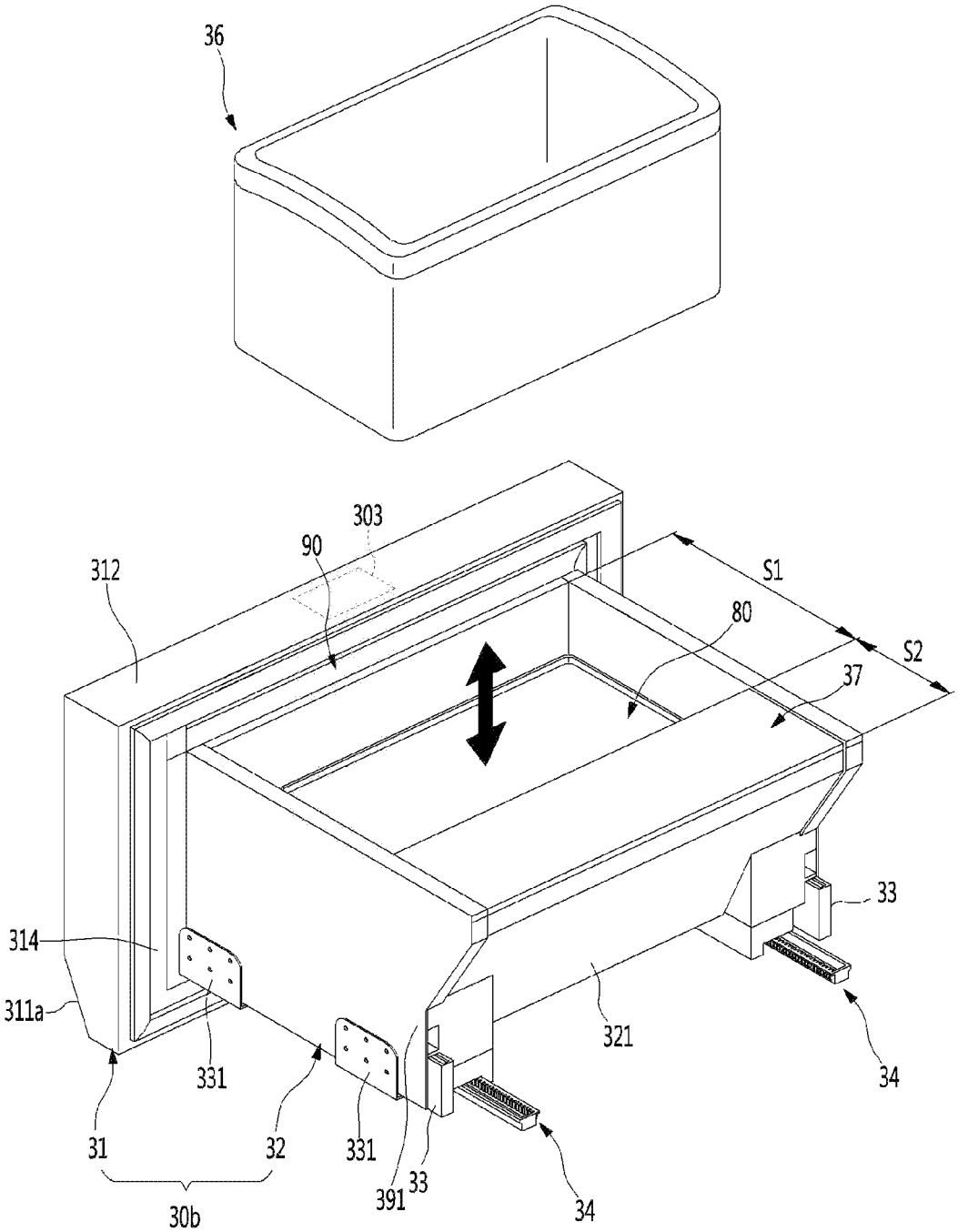

【Figure 4】
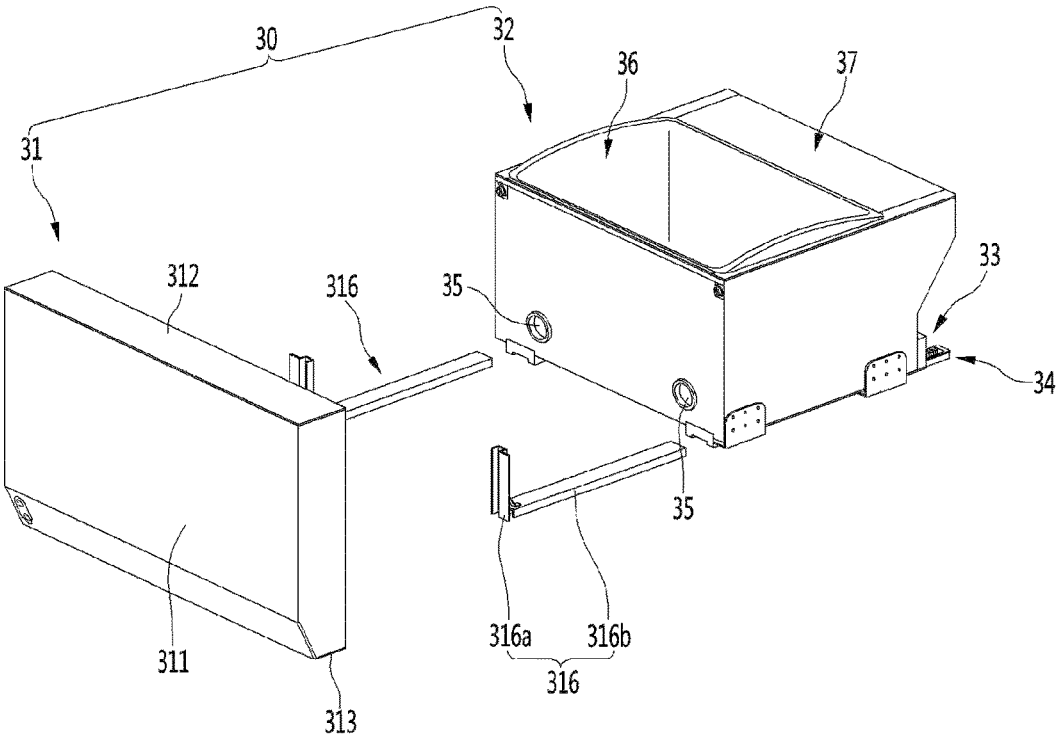

【Figure 5】
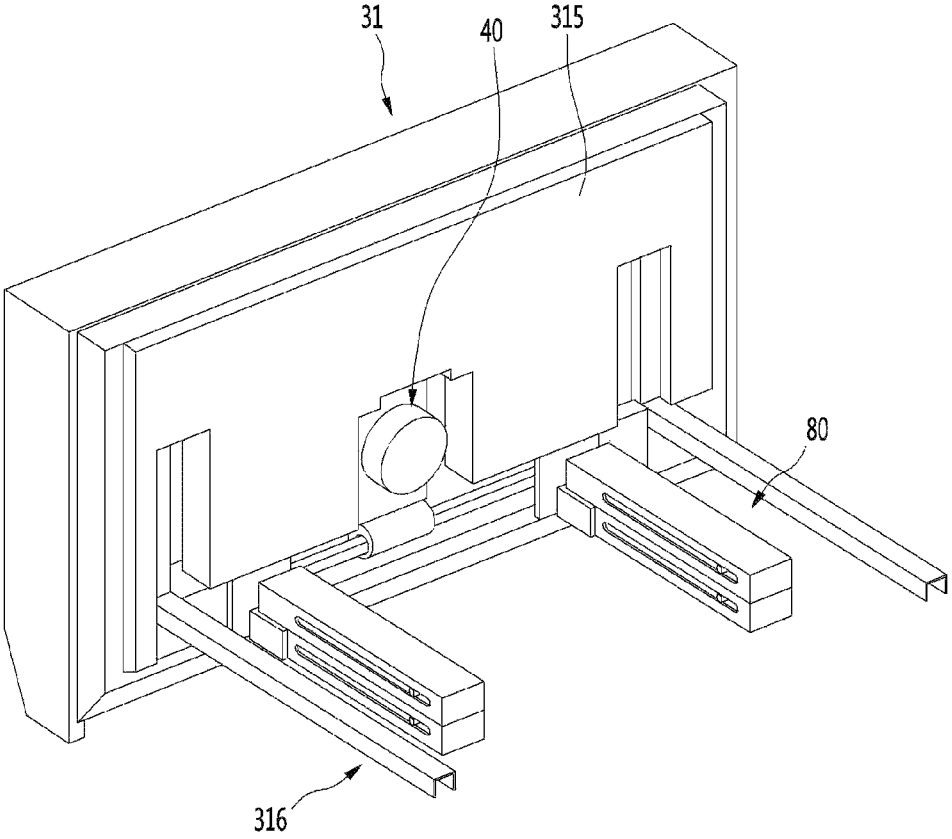

【Figure 6】
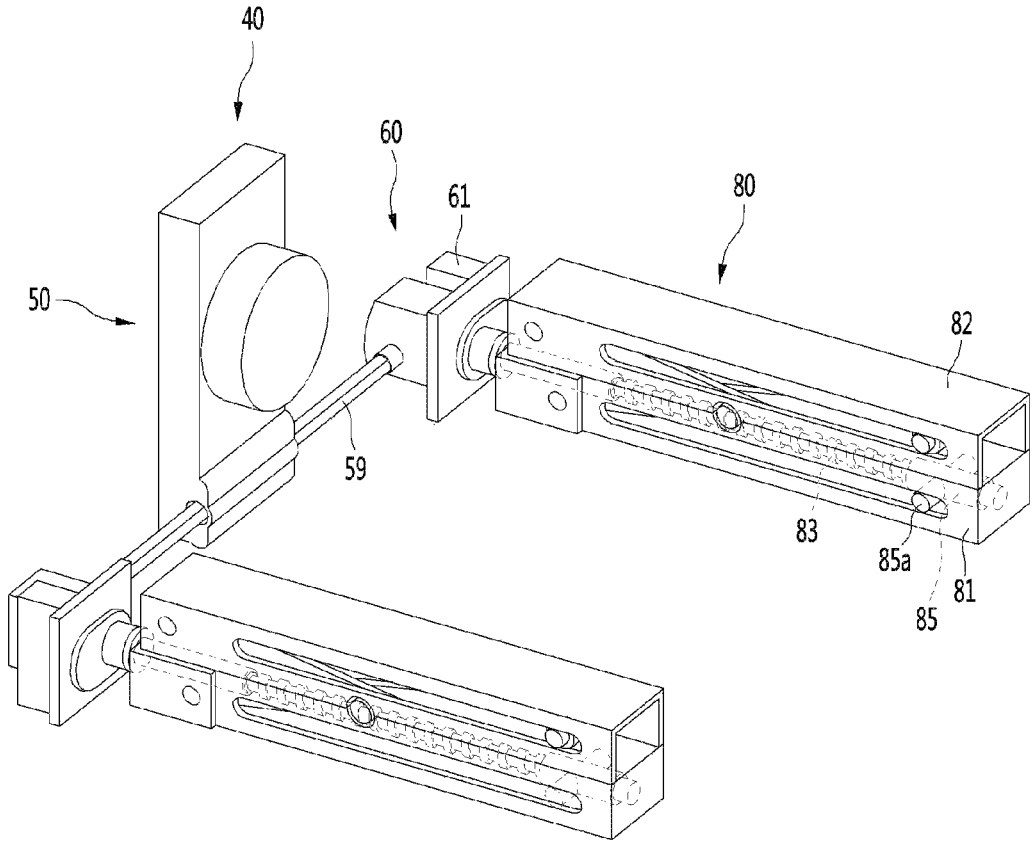

【Figure 7】
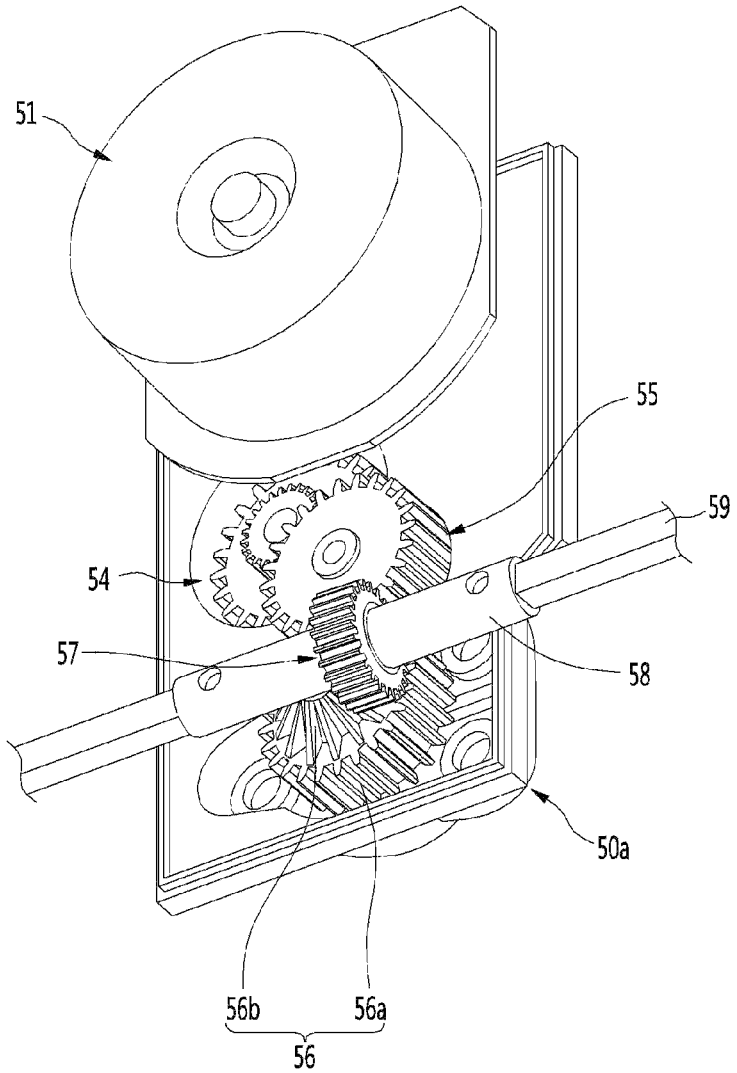

【Figure 8】
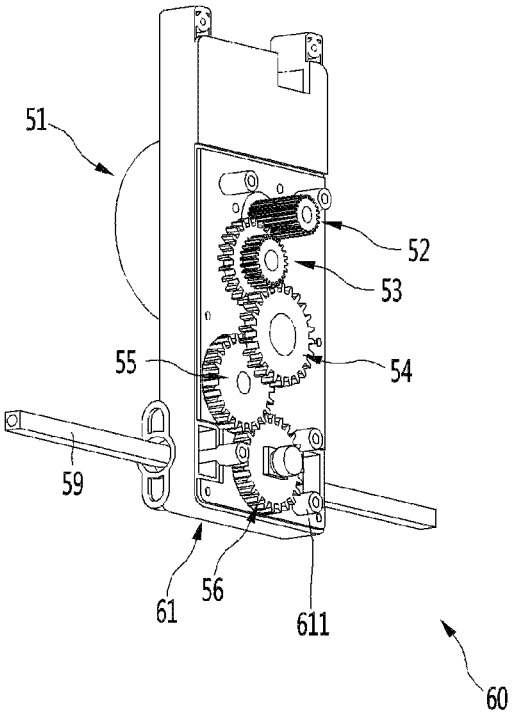

【Figure 9】
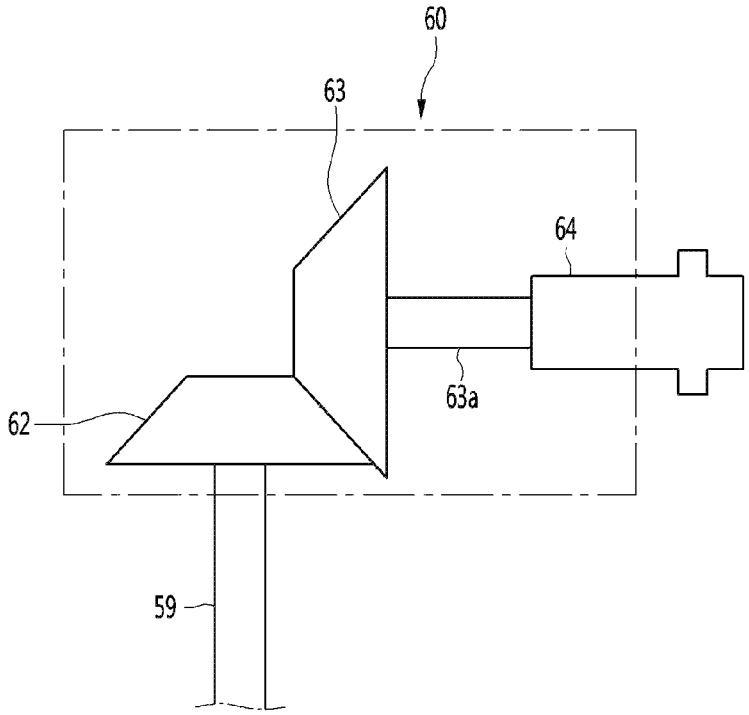

【Figure 10】
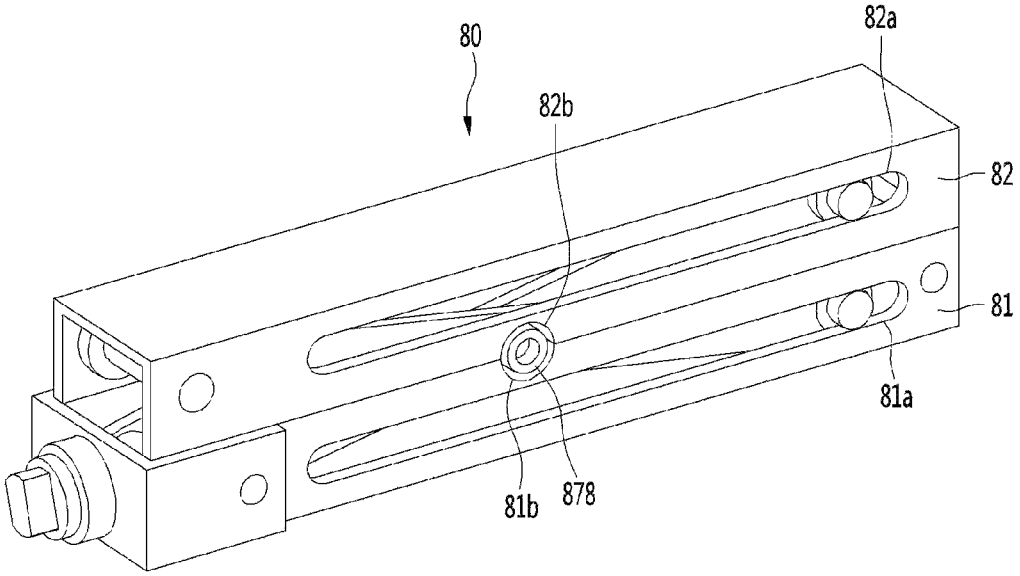

【Figure 11】
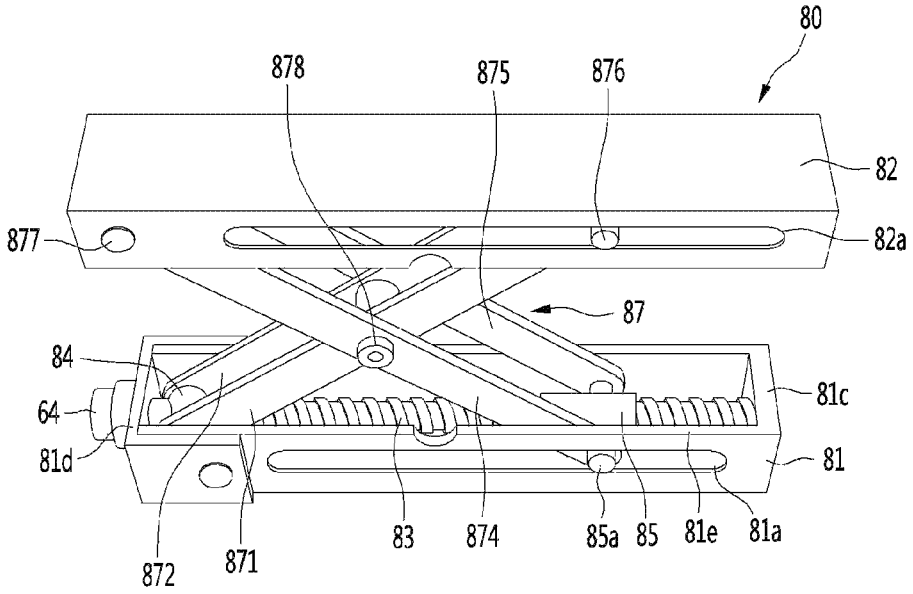

【Figure 12】
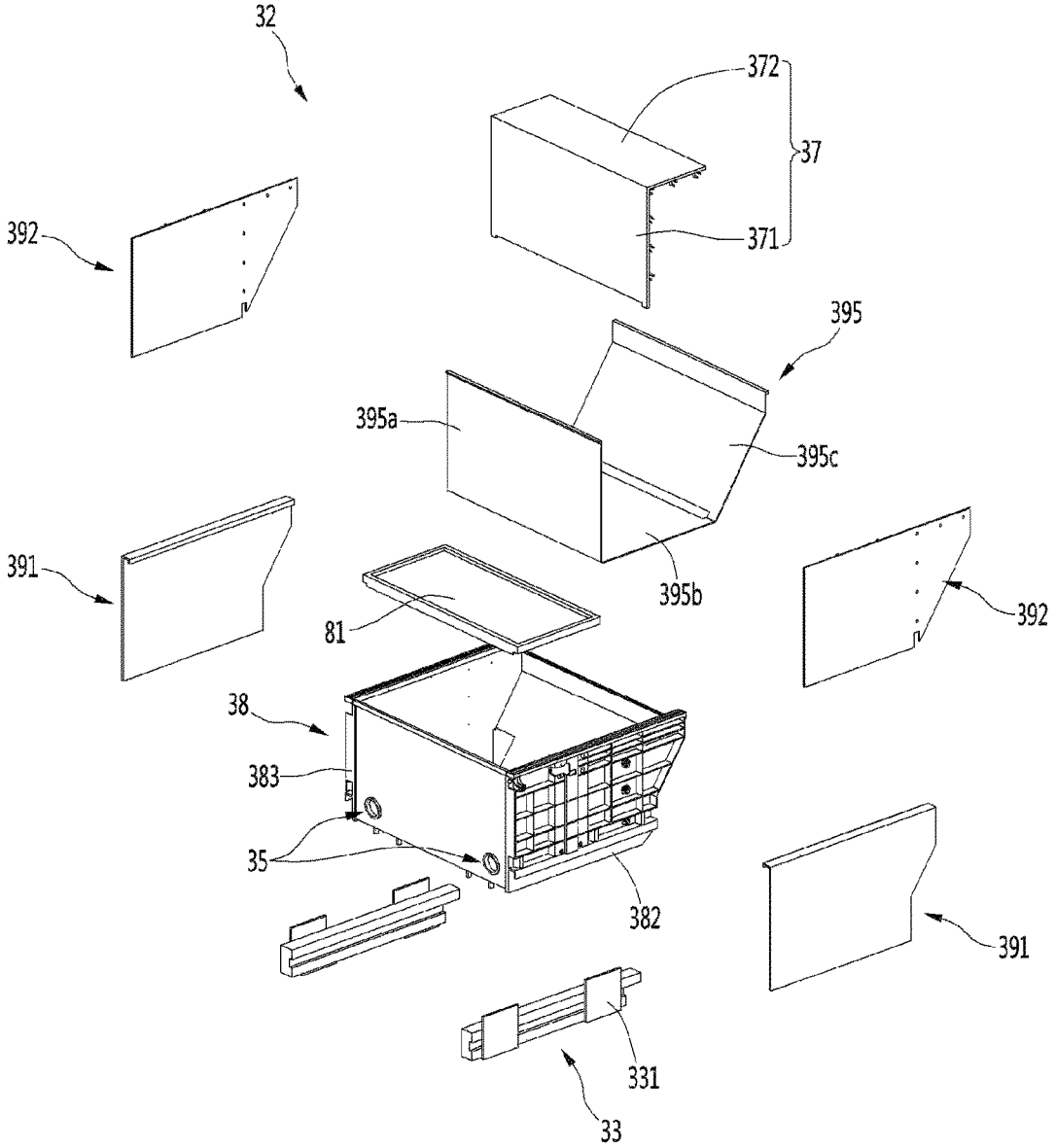

【Figure 13】
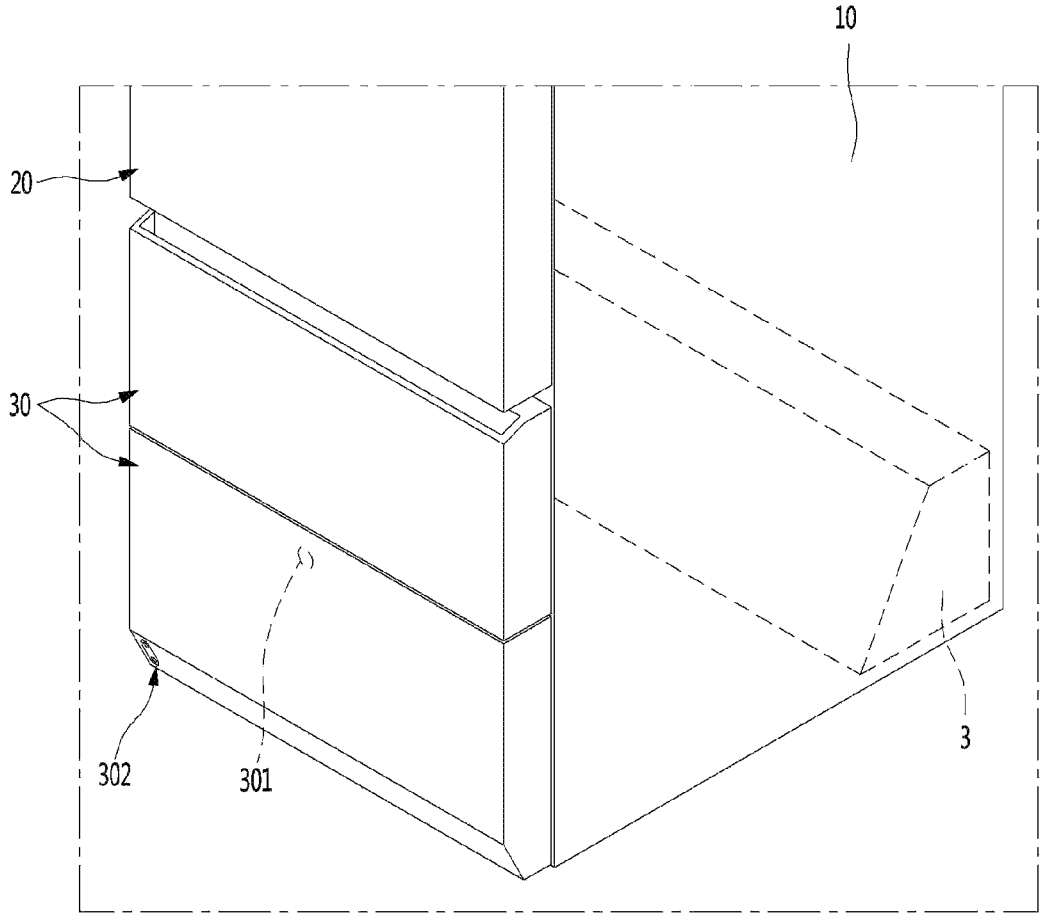

【Figure 14】
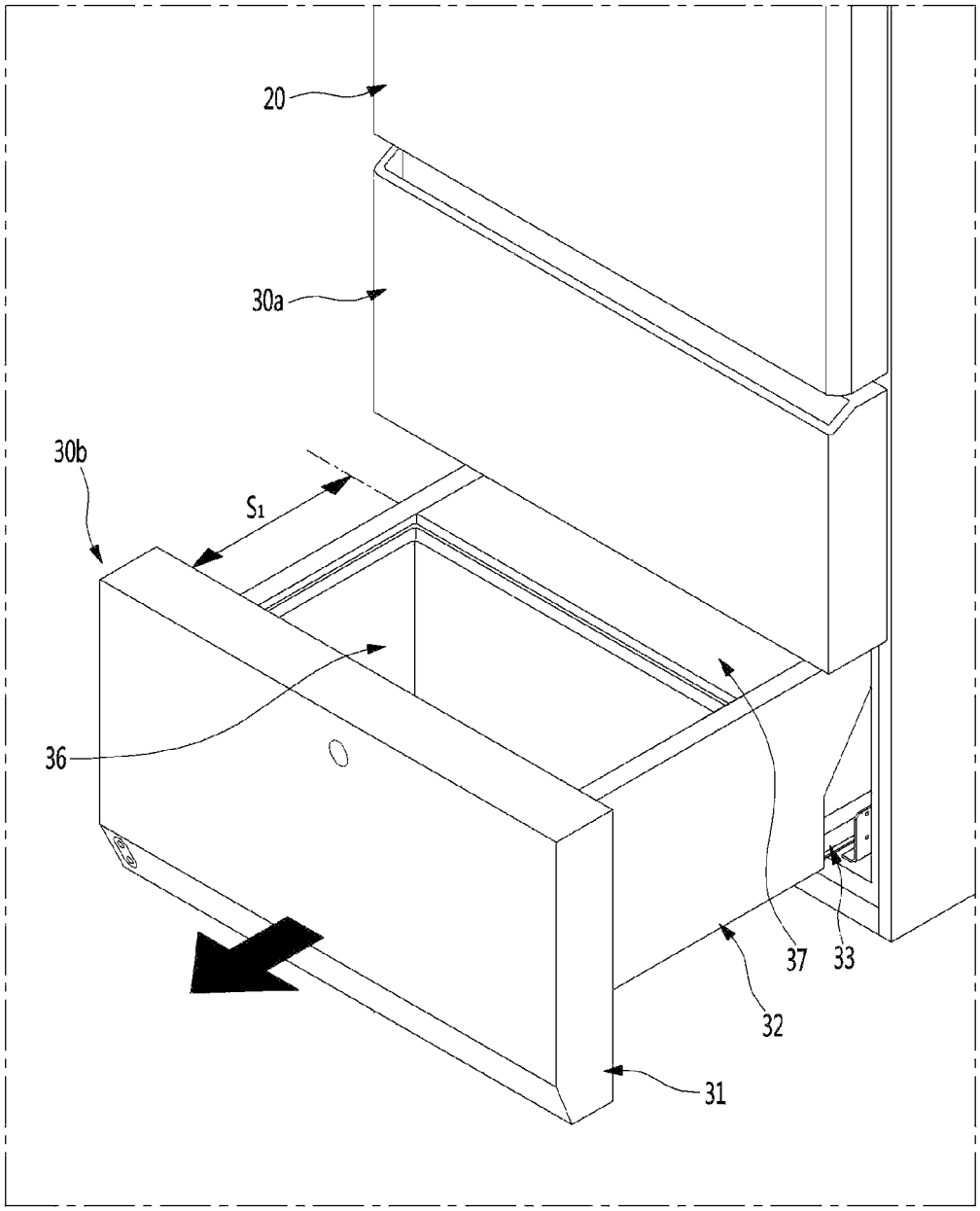

【Figure 15】
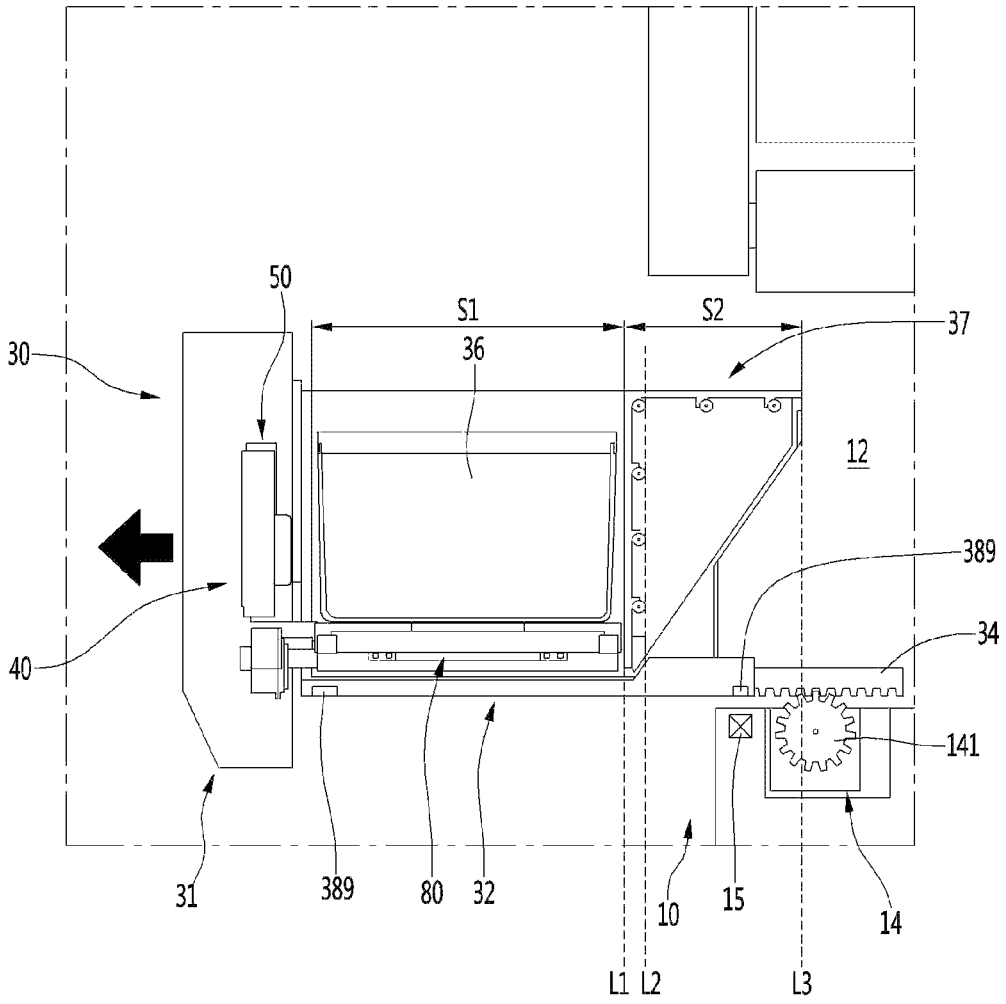

【Figure 16】
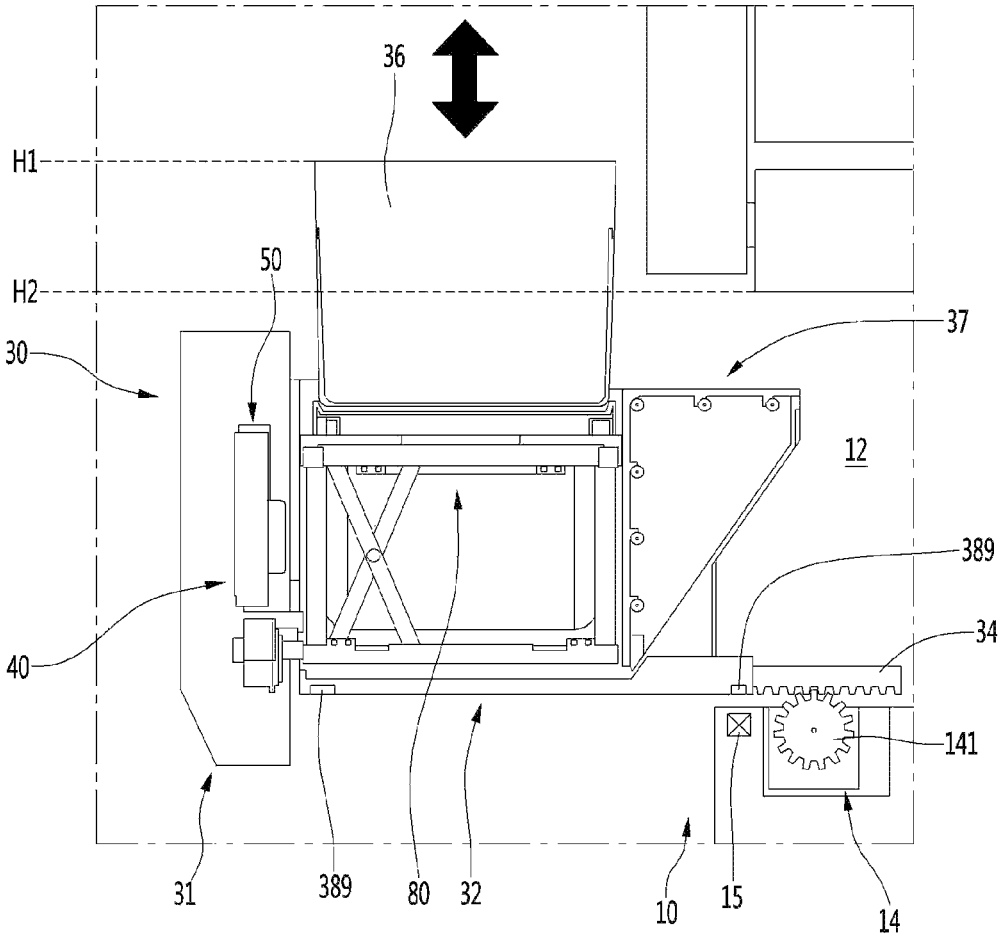

【Figure 17】
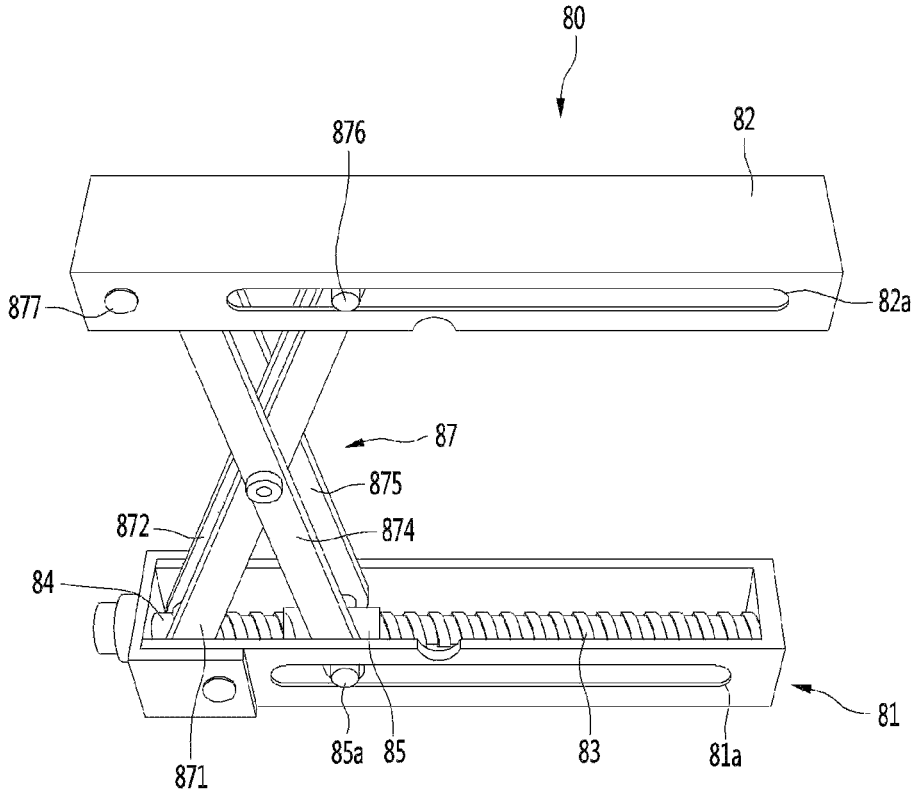

【Figure 18】
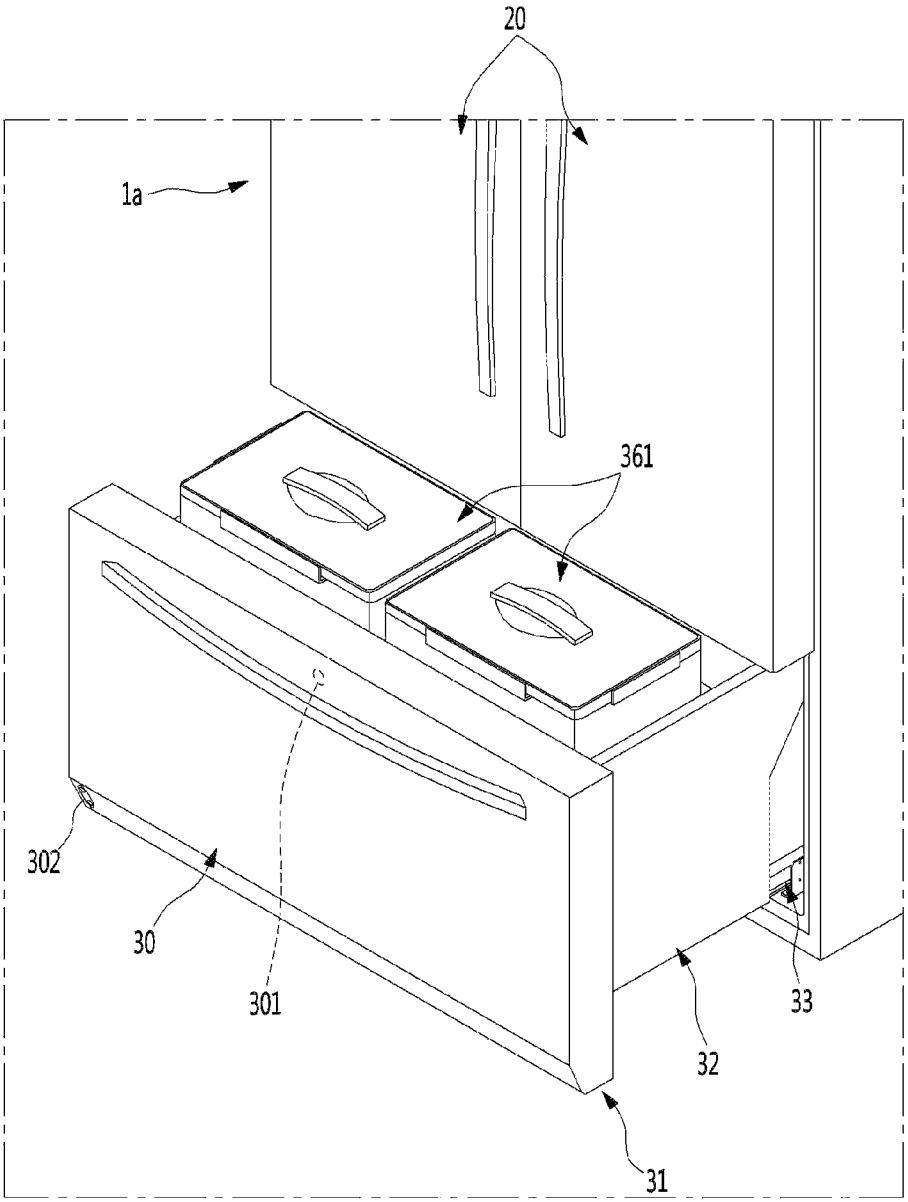

【Figure 19】
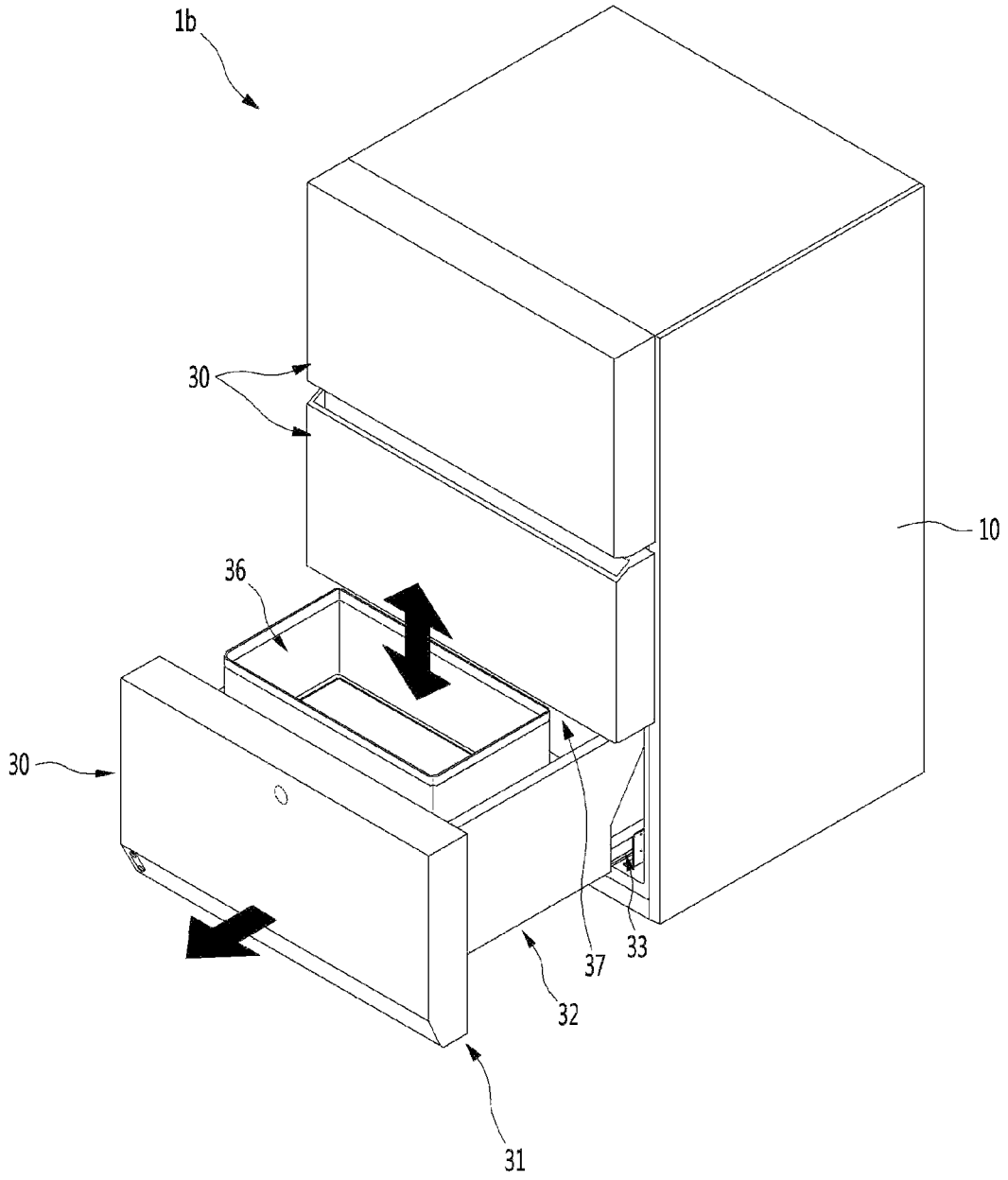

【Figure 20】
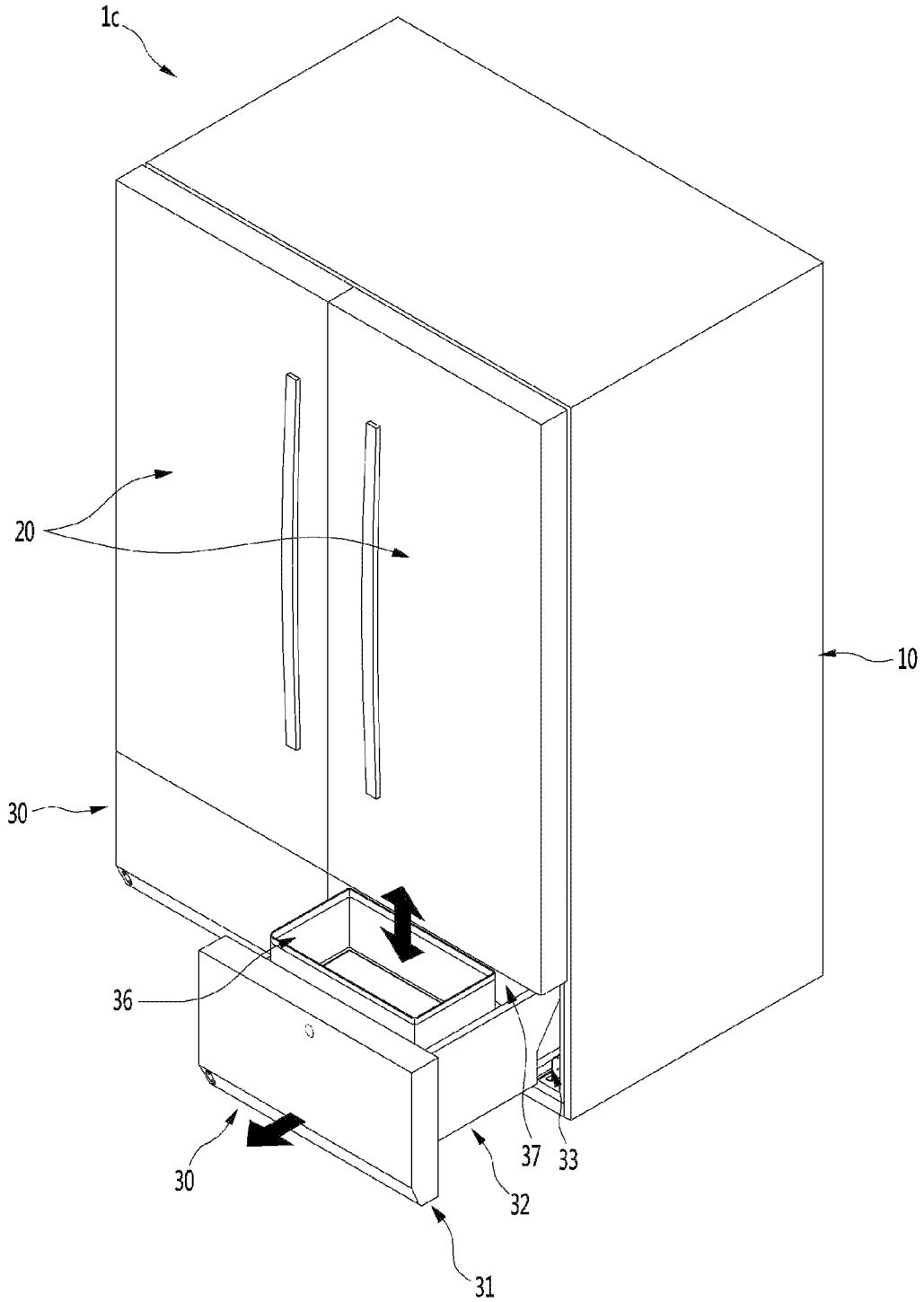

REFRIGERATOR

This application is a National Stage Application of International Application No. PCT/KR2019/013634, filed Oct. 17, 2019, which claims the benefit of Korean Patent Application No. 10-2018-0125328, filed Oct. 19, 2018, the contents of which are all hereby incorporated by reference herein in their entirety.

TECHNICAL FIELD

The present disclosure relates to a refrigerator.

BACKGROUND ART

In general, refrigerators are home appliances for storing foods at a low temperature in a storage space that is covered by a door. For this, refrigerators cool the inside of the storage space by using cool air generated by being heat-exchanged with a refrigerant circulated through a refrigeration cycle to store foods in an optimum state.

In recent years, refrigerators have become increasingly multi-functional with changes of dietary lives and gentrification of products, and refrigerators having various structures and convenience devices for convenience of users and for efficient use of internal spaces have been released.

The storage space of the refrigerator may be opened/closed by the door. Also, refrigerators may be classified into various types according to an arranged configuration of the storage space and a structure of the door for opening and closing the storage space.

The refrigerator door may be classified into a rotation-type door that opens and closes a storage space through rotation thereof and a drawer-type door that is inserted and withdrawn in a drawer type.

Also, the drawer-type door is often disposed in a lower region of the refrigerator. Thus, when the drawer-type door is disposed in the lower region of the refrigerator, a user has to turn its back to take out a basket or foods in the drawer-type door. If the basket or the foods are heavy, the user may feel inconvenient to use the basket or may be injured.

In order to solve such a limitation, various structures are being developed in which the drawer-type door is capable of being elevated.

Representatively, a refrigerator including a lifting mechanism for moving up or down a bin disposed in a refrigerating compartment has been disclosed in U.S. Pat. No. 9,377,238.

However, in such a related art, the lifting mechanism for lifting has a structure disposed and exposed outside of the bin, which may cause a severe problem with safety. Further, there is a problem in that the external appearance is deteriorated by the exposed structure of the lifting mechanism.

Since a driving unit has a structure exposed outside, when the driving unit is operated, noise can be wholly transmitted to the outside, which may cause complaint of users.

The lifting mechanism is disposed in the refrigerator, so the storage capacity of the refrigerator may be remarkably decreased, which results in a loss of storage capacity of the entire refrigerator, thus, causing a problem in that the storage efficiency is considerably decreased.

The lifting mechanism is fully provided in the refrigerator, so it is required to separate the door and the lifting mechanism in order to provide services for the lifting mechanism, and accordingly, it is difficult to provide the services.

The driving unit of the lifting mechanism has a structure being able to lift the bin by pushing an end of a scissor supporting assembly. Accordingly, when a bin has a large size or a bin is filled with heavy objects, there is a problem in that it is difficult to provide sufficient force for lifting. Obviously, it may be possible to increase the motor of the driving unit in order to solve this problem, but in this case, there is another problem in that the loss of volume in the refrigerator and noise are further increased and the manufacturing cost is also increased.

The lifting mechanism supports a side of the entire bottom of the bin due to the position of the driving unit, so an eccentric load is unavoidably generated when objects are stored in the bin. A severe problem with safety may be caused by an eccentric load that is applied with the door drawn out, and there is also a problem in that elevation cannot be smoothly performed.

The lifting mechanism has a structure in which the whole bin is elevated. In order to elevate the bin, the bin has to be fully drawn out of the storage space of the refrigerator and has to be drawn out to a position where it does not interfere with an upper door and the refrigerator main body to prevent interference with elevation.

DISCLOSURE

Technical Problem

The present embodiment provides a refrigerator in which an electric device for elevation is provided in a door unit and a mechanical device for elevating a drawer unit is provided in a drawer outside a door.

The present embodiment provides a refrigerator that improves an external appearance and safety by preventing exposure of components for elevating a drawer unit.

The present embodiment provides a refrigerator that can secure stable elevation by preventing a drawer unit from sinking due to an eccentric load during elevation.

The present embodiment provides a refrigerator that can minimize reduction in volume of the inside of a drawer unit by decreasing the volume of an elevation device.

Technical Solution

A refrigerator according to an embodiment of the present invention may include: a cabinet having a storage space; a door including a door unit configured to open or close the storage space and a drawer unit configured to provide a receiving space; a driving device disposed at the door unit and including a driving motor configured to provide power; and an elevation device disposed at the drawer unit, connected with the driving device, and configured to move up or down.

The elevation device may include: a lower frame; an upper frame positioned over the lower frame; a scissor assembly configured to connect the lower frame and the upper frame; and a screw rotatably supported on the lower frame, configured to be rotated by driving force transmitted from the driving device disposed at the door unit, and connected with the scissor assembly.

The driving device may include: a motor assembly including the driving moor and a power transmission unit configured to transmit power of the driving motor; and a transmission unit configured to transmit power of the motor assembly to the elevation device.

For example, a pair of transmission units may be disposed at both sides of the motor assembly, and the elevation device may be connected to each of the pair of transmission units.

The elevation device may further include a supporting plate seated on a plurality of upper frames.

In this embodiment, the power transmission unit may include: a plurality of transmission gears configured to transmit the power of the driving motor; a shaft driving gear connected to a final gear of the plurality of transmission gears; and a plurality of shafts connected to the shaft driving gear and extending to both sides of the shaft driving gear.

An extension direction of an axial line of the driving motor may cross an extension direction of an axial line of the shaft driving gear.

The transmission unit may include: a first unit gear connected with the shaft; and a second unit gear connected with the first unit gear. An axial line of the first unit gear may cross an axial line of the second unit gear.

The transmission unit may further include a connector configured to connect the second unit gear and the screw to each other.

The connector may be connected to the screw through the lower frame.

The drawer unit may include a drawer opening for passing the connector.

In this embodiment, the scissor assembly may include: a plurality of first rods; and a plurality of second rods disposed across the plurality of first rods.

An end of the screw may be rotatably supported on a first wall of the lower frame, and another end of the screw may be connected to the motor assembly through a second wall positioned opposite the first wall.

The elevation device may further include a movable unit through which the screw is coupled, and first ends of the plurality of second rods may be rotatably connected to the movable unit.

Second ends of the plurality of second rods may be rotatably connected to the lower frame.

Guide protrusions may be disposed on both sides of the movable unit, and the guide protrusions may pass the plurality of second rods, respectively.

First slots in which the guide protrusions are inserted may be formed at a pair of third walls connecting the first wall and the second wall of the lower frame.

The first slots may be elongated in a longitudinal direction of the screw.

The elevation device may further include a supporting shaft positioned adjacent to the second wall and rotatably supporting first ends of the plurality of first rods.

The screw may pass through the supporting shaft.

The elevation device may further include a movable shaft rotatably supporting second ends of the plurality of first rods and movably connected to the upper frame.

The upper frame may include a second slot in which the movable shaft is inserted and that extends in a longitudinal direction of the screw.

The upper frame may be seated on a top surface of the lower frame, with the upper frame moved to a lowermost position.

The scissor assembly may include a connection shaft configured to connect the plurality of first rods and the plurality of second rods.

An accommodating groove in which the connection shaft is accommodated in a state in which the upper frame is seated on the top surface of the lower frame may be formed on each of the upper frame and the lower frame.

Advantageous Effects

It is possible to expect the following effects from refrigerators according to proposed embodiments.

A refrigerator according to an embodiment of the present invention is configured such that a portion of a receiving space in a drawer door can be moved up and down with the drawer door drawn out. Accordingly, a user does not need to excessively bend over when putting food into the drawer door disposed at a lower position, so convenience in use can be improved.

In particular, in order to pick up heavy food or a container with food therein, a user has to apply large for to pick up the food or the container, but the elevation device in the drawer door is moved up to a position where use is convenient by the driving device. Accordingly, there in an advantage in that it is possible to prevent an injury on a user and remarkably improve convenience in use.

The driving device that is configured as an electric device for providing power is disposed in the door unit and the elevation device has a structure disposed in the drawer unit, so both of the driving device and the elevation device are not exposed to the outside. Accordingly, safety in use can be secured and the external appearance can be improved.

In particular, since the driving device that is configured as an electric device is disposed in the door unit, it is possible to preclude of approach of a user. Accordingly, it is possible to expect an effect that can prevent occurrence of a safety accident.

Further, since the driving device is disposed in the door, noise is blocked, so there is an advantage in that it is possible to reduce noise in use.

Since the driving device that occupies a considerable part of the entire configuration is disposed at the door unit, it is possible to minimize a loss of storage capacity of the drawer unit. The elevation device has a structure that is folded in compact size and accommodated when it is moved down, so there is an advantage in that it is possible to secure a storage capacity in the refrigerator.

Further, a screw that rotates exists in the elevation device and the elevation device can be moved up and down by a movable unit that moves along the screw when the screw rotates, so there is an advantage that the structure of the elevation device is simplified and the volume of the elevation device can be minimized.

Since the elevation device can be provided at a portion of the front porting of the drawer unit, it is possible to move up and down the elevation device without interference by the upper door or the cabinet even though the drawer unit is not drawn out such that it is fully exposed to the outside. Accordingly, and there is an advantage in that it is possible to prevent sinking due to excessive drawing-out of a heavy drawer door or a problem with durability and it is possible to prevent a loss of cold air due to excessive drawing-out of a drawer.

Further, since a structure in which not the entire, but a portion of the drawer is moved up and down is taken, it is possible to make the entire moving-up and down structure compact and to use a light structure. Accordingly, it is possible to minimize a loss of storage capacity and maintain a simple configuration.

DESCRIPTION OF DRAWINGS

FIG. 1 is a front view of a refrigerator according to an embodiment of the present invention.

FIG. 2 is a cross-sectional view schematically showing an elevated state of a lower drawer door of the refrigerator according to an embodiment of the present invention.

FIG. 3 is a perspective view when a container of the lower drawer door is separated.

FIG. 4 is an exploded perspective view seen from the front when a drawer unit and a door unit of the lower drawer door are separated.

FIG. 5 is a rear perspective view of the door unit.

FIG. 6 is a perspective view showing the state when an elevation device is connected to the driving device.

FIGS. 7 and 8 are views showing the structure of a motor assembly according to an embodiment of the present invention.

FIG. 9 is a view showing a transmission unit according to an embodiment of the present invention.

FIG. 10 is a perspective view of an elevation device according to an embodiment of the present invention.

FIG. 11 is a view showing the state when an upper frame of the elevation device of FIG. 10 is moved up at a predetermined height.

FIG. 12 is an exploded perspective view of the drawer unit of FIG. 4.

FIG. 13 is a perspective view showing the state when the drawer unit is closed.

FIG. 14 is a perspective view showing the state when a lower drawer door is fully open.

FIG. 15 is a cross-sectional view of the drawer door in the state when the container of the drawer door is fully moved down.

FIG. 16 is a cross-sectional view of the drawer door in the state when the container of the lower drawer door is fully moved up.

FIG. 17 is a view showing the state when an upper frame of the elevation device is fully moved up.

FIG. 18 is a perspective view of a refrigerator according to another embodiment of the present invention.

FIG. 19 is a perspective view of a refrigerator according to another embodiment of the present invention.

FIG. 20 is a perspective view of a refrigerator according to another embodiment of the present invention.

MODE FOR INVENTION

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

FIG. 1 is a front view of a refrigerator according to an embodiment, FIG. 2 is a schematic view illustrating a state in which a lower drawer door of the refrigerator is inserted and withdrawn and is elevated, and FIG. 3 is a perspective view when a container of the lower drawer door is separated.

Referring to FIGS. 1 to 3, the refrigerator 1 may have a cabinet 10 defining a storage space and a door 2 covering an opened front surface of the cabinet 10.

The storage space of the cabinet 10 may be divided into a plurality of spaces. For example, an upper space of the cabinet 10 may be provided as a refrigerating compartment 11, and a lower space of the cabinet 10 may be provided as a freezing compartment 12. Each of the upper space and the lower space may be provided as an independent space that is maintained at a different temperature, except for the refrigerating compartment and the freezing compartment. The upper space and the lower space may be called an upper storage space 11 and a lower storage space 12.

The door 2 may comprise a rotation door 20 opening and closing the upper space through rotation thereof and a drawer door 30 opening and closing the lower space by being inserted or withdrawn in a drawer type. The lower space may be vertically divided again. The drawer door 30 may comprise an upper drawer door 30*a* and a lower drawer door 30*b*.

An outer appearance of each of the rotation door 20 and the drawer door 30 may be made of a metal material and be exposed to the front side.

Although the refrigerator in which all of the rotation door 20 and the drawer door 30 are provided is described, the present disclosure is not limited thereto. For example, the present disclosure may be applied to all refrigerators including a door that is inserted and withdrawn in the drawer type.

The rotation door 20 is disposed at an upper position, so it can be referred to as an upper door, and the drawer door 30 is disposed at a lower position, so it can be referred to as a lower door.

A display 21 may be disposed on one side of a front surface of the rotation door 20. The display 21 may have a liquid crystal display structure or a 88 segment structure. Also, when the outer appearance of the door 2 is made of the metal material, a plurality of fine holes are punched in the door 2 to display information by using light passing therethrough.

A manipulation part 22 that is capable of manipulating automatic rotation or withdrawal of the upper door 2 or the lower door 2 may be provided on one side of the rotation door 20.

The manipulation part 22 may be integrated with the display 21 and may operate in a touch manner or a button manner. The manipulation part 22 may input an overall operation of the refrigerator 1 and manipulate an insertion and withdrawal of the drawer door 30 or an elevation of a container within the drawer door.

A manipulation part 301 may also be provided on the drawer door 30. The manipulation part 301 may be disposed on one side of the lower drawer door 30*b* that is disposed at the lowermost portion of the drawer door 30. The manipulation part 301 may operate in a touch or button manner. The manipulation part 301 may be provided as a sensor detecting proximity or movement of a user or provided as an input unit that operates by a user's motion or voice.

As illustrated in the drawing, a manipulation device 302 may be disposed on a lower end of the lower drawer door 30*b* to illuminate an image on a bottom surface and thereby to output a virtual switch and to input an operation in such a manner that the user approaches a corresponding area.

The lower drawer door 30*b* may be automatically inserted and withdrawn according to the manipulation of the manipulation part 301. Also, a food or container 36 within the lower drawer door 30*b* may be elevated in a state in which the drawer door 30 is withdrawn by the manipulation of the manipulation part 301.

That is, the automatic insertion and withdrawal and/or automatic elevation of the lower drawer door 30*b* may be performed by at least one of a plurality of manipulation devices 22, 301, 302, and 303. As necessary, only one of the plurality of manipulation devices 22, 301, 302, and 303 may be provided in the refrigerator.

In particular, an inclined portion 311*a* is formed at an angle at the lower portion of the front surface of the lower drawer door 30*b* and manipulation device 302 may be mounted on the inclined portion 311*a*. The manipulation device 302 includes a projector light, which can output image, a proximity sensor, etc., so it can project a virtual switch in an image type on a floor and can sense whether a user has selected the virtual switch through the proximity sensor.

Obviously, the manipulation device 302 may simply include only a proximity sensor. Automatic drawing-in and out and/or elevation of the lower drawer door 30*b* can be manipulated by manipulation of the manipulation device 302.

A manipulation device 303 may be provided on the top surface of the lower drawer door 30*b*. When a manipulation device 303 is provided on the top surface of the lower drawer door 30*b*, the manipulation device is not exposed to the outside when the lower drawer door 30*b* is closed, so the manipulation device cannot be manipulated. Accordingly, the manipulation device 303 can be used to move up and down the lower drawer door 30*b*.

Meanwhile, since there are provided the manipulation devices 22, 301, 302, and 303 and they can be used for drawing in and out and moving up and down the lower drawer door 30*b*, and drawing-in and out and moving-up and down can be manipulated in accordance with manipulation combination of sequential manipulation of the plurality of manipulation devices 22, 301, and 302.

In order to receive food received in the lower drawer door 30*b*, it is possible to draw out forward the lower drawer door 30*b* and then move up the container 36 in the lower drawer door 30*b*.

On the other hand, the container 36 may have a predetermined height. Since the container 36 is seated on an elevation device 80 to be described below, when the elevation device 80 is moved up, the height of the container 36 can be added to the height of the elevation device 80. Accordingly, when the elevation device 80 is moved up, it may be positioned at a point where a user easily approaches the container 36 or lifts the container 36.

Accordingly, the container 36 can be fully received in the drawer unit 32 when the lower drawer door 30*b* is drawn in and out, and when the elevation device 80 is moved up, it may be positioned at a higher position than the lower space 12.

Meanwhile, the shape of the container 36 is not limited, but may be a shape corresponding to the size of a front space S1. Further, it may be preferable that the container 36 is configured to have a predetermined height such that food received therein is not separated even though the elevation device 80 is moved up.

According to this manipulation, it is possible to more easily lift and use the food or the container 36 in the drawer door 30 disposed at the lowermost position.

The lower drawer door 30*b* may be automatically drawn in and out forward and rearward by a drawing motor 14 and a pinion 141 disposed in the cabinet 10, and a drawing rack 34 disposed on the bottom surface of the lower drawer door 30*b*.

The container in the lower drawer door 30*b* can be moved up and down by the driving device 40 and the elevation device 80 disposed at the lower drawer door 30*b*.

Hereafter, the lower drawer door 30*b* and the configuration for operation of the lower drawer door 30*b* of the present invention are described in more detail, and unless specifically stated, the lower drawer door 30*b* is referred to as a "drawer door" or a "door".

Meanwhile, embodiments of the present invention are not limited to the number and shape of drawer doors and can be applied to all of refrigerators having a door that is drawn in and out in a drawer type in a lower storage space.

FIG. 4 is an exploded perspective view seen from the front when a drawer unit and a door unit of the lower drawer door are separated.

Referring to FIGS. 1 to 4, the door 30*b* may include a door unit 31 opening and closing the storage space and a drawer unit 32 coupled to the rear surface of the door unit 31 to be drawn in and out together with the door unit 31.

The door unit 31 is exposed outside the cabinet 1 and can form the external appearance of the refrigerator 1 and the drawer unit 32 is disposed in the cabinet 10 and can form a receiving space. The door unit 31 and the drawer unit 32 are combined with each other, so they can be drawn in and out forward and rearward together.

The drawer unit 32 is disposed on the rear surface of the door unit 31 and can form a space where food or a container to be stored is received. The inside of the drawer unit 32 may form a receiving space that is open upward, and the external appearance of the drawer unit 32 may be formed by several plates (see 391, 392, and 395 in FIG. 12).

The several plates 391, 392, and 395 may be made of a metal material such as stainless steel and are disposed not only outside, but also inside the drawer unit 32 such that the entire drawer unit 32 has the texture of stainless steel or a texture like stainless steel.

A machine room 3 where a compressor, a condenser, etc. constituting a refrigeration cycle are disposed may be disposed behind the door 30*b* when the door 30*b* is drawn in. Accordingly, the rear portion of the drawer unit 32 may be formed in a shape in which the upper end protrudes rearward further than the lower end, and the rear surface of the drawer unit 32 may include an inclined surface 321.

Drawing rails 33 that can guide the door 30*b* being drawing in and out may be disposed on both sides of the drawer unit 32. The door 30*b* can be mounted on the cabinet 10 to be able to be drawn in and out by the drawing rails 33. The drawing rails 33 are covered by an outer side plate 391, whereby they cannot be exposed to the outside. The drawing rails 33 may be configured in a rail structure that can be stretched in multiple stages.

The drawing rails 33 may have a rail bracket 331 and the rail bracket 331 may extend to both sides of the drawer unit 32 from sides of the drawing rails 33. The rail bracket 331 may be coupled and fixed to a wall in the refrigerator. Accordingly, the drawer unit 32, that is, the door 30*b* can be mounted on the cabinet 10 to be able to be drawn in and out by the drawing rails 33.

Further, the drawing rails 33 may be disposed on the lower ends of both sides of the drawer unit 32, and accordingly, the drawing rails 33 may be understood as being disposed on the bottom surface of the drawer unit 32.

Accordingly, the drawing rails 33 are disposed on the lower ends of both sides of the drawer unit 32 and may be referred to as under rails.

A drawing rack 34 may also be disposed on the bottom surface of the drawer unit 32. The drawing rack 34 may be disposed on both left and right sides, and enables the door 30 to be automatically drawn in and out in cooperation with the drawing motor 14 mounted in the cabinet 10. That is, when manipulation is input through the manipulation parts 22 and 301, the drawing motor 14 is driven, so the door 30*b* can be drawn in and out along the drawing racks 34. In this case, the door 30 can be stably drawn in and out by the drawing rails 33.

Obviously, the drawing rack 34 may not be disposed on the drawer unit 32 and the drawer unit 32 may be configured such that a user draws in and out the door 30*b* in person by holding and pushing or pulling a side of the door unit 31.

Meanwhile, the inside of the drawer unit 32 may be divided into a front space S1 and a rear space S2. The elevation device 80 that is moved up and down and the container 36 that is seated on the elevation device 80 and moved together with the elevation device 80 may be disposed in the front space S1.

The container 36 is shown in a basket shape with an open top, but may have a closed box structure such as a Kimchi container, and several containers may be stacked or disposed in parallel.

When the door 30*b* is drawn out, the entire drawer unit 32 cannot be drawn out of the storage space due to a limitation in the drawing-out distance of the door 30. Further, at least the front space S1 is drawn out of the storage space and the entire or a portion of the rear space S2 is positioned in the storage space in the cabinet 1.

The larger the drawing-out distance of the door 30, the lager the moment that is applied to the door 30 when the door 30 has been drawn out, so it is difficult to maintain a stable state and the drawing rails 33 or the drawing racks 34 may be caused to be deformed or damaged. Accordingly, it is required to limit the drawing-out distance of the door 30.

The drawing-out distance of the door 30 may be limited by the drawing racks 34 or the drawing rails 33.

The elevation device 80 and the container 36 are accommodated in the front space S1 and the elevation device 80 can move up and down food or the container 36 seated on the elevation device 80 while vertically moving up and down. The elevation device 80 may be disposed under the container 36, and when the container 36 is mounted, the elevation device 80 can be covered by the container 36. Accordingly, even any component of the elevation device 80 is not exposed to the outside.

A separate drawer cover 37 may be disposed in the rear space S2. The front space S1 and the rear space S2 can be divided by the drawer cover 37. When the drawer cover 37 is mounted, the front surface and the top surface of the rear space S2 are covered such that a space that is not used is not exposed to the outside.

However, when the drawer cover 37 is separated, it is possible to approach the rear space S2 and to put food into the rear space S2. In order to use the rear space S2, a separate pocket or a container corresponding to the shape of the rear space may be disposed in the rear space S2.

In order to use the entire space in the drawer unit 32, the elevation device 80 in the drawer unit 32 can be simply separated and mounted, and it may be possible to use the entire internal space of the drawer unit 32 by separating the elevation device 80 and the drawer cover 37.

The external appearances of the inner side and the outer side of the drawer unit 32 may be formed by the plates (see 391, 392, and 395 in FIG. 10) and it may be possible to cover the components mounted in the drawer unit 32 so that the external appearances of the inside and outside can be shown clean. There may be provided several plates (see 391, 392, and 395 in FIG. 10) and may be made of a stainless material, thereby being able to provide a more luxurious and clean external appearance.

On the other hand, the door unit 31 and the drawer unit 32 that constitute the door 30*b* may have structures that can be combined with and separated from each other. It is possible to improve workability and to more conveniently provide services through the separable structure of the door unit 31 and the drawer unit 32.

The rear surface of the door unit 31 and the front surface of the drawer unit 32 can be coupled to each other, and when the door unit 31 and the drawer unit 32 may be configured to be able to provide power for moving up and down the elevation device 80 when they are combined.

The driving device (see 40 in FIG. 6) for moving up and down the elevation device 80 may be disposed on the door unit 31, and the door unit 31 and the drawer unit 32 may be selective connected.

In particular, the driving unit (see 40 in FIG. 6) disposed on the door unit 31 may be composed of components that are operated by input power and components for transmitting power to the elevation device 80. Accordingly, when a service for the driving unit (see 40 in FIG. 6) is required, it is possible to take measures by separating the door unit 31 and it is possible to easily take measures by replacing only the door unit 31.

The door unit 31 and the drawer unit 32 may be combined by a pair of door frames 316 disposed on both sides.

The door frame 316 may include a door coupling part 316*a* vertically extending and coupled to the door unit 31, and a drawer coupling part 316*b* extending rearward from the lower end of the door coupling part 316*a*.

The door coupling part 316*a* may be coupled to the door unit 31 by a separate coupling member and may be coupled to a side of the door unit 31 by a simple coupling structure. The drawer coupling part 316*b* is inserted in both sides of the drawer unit 32 and may be disposed adjacent to the drawing rails 33.

With the door coupling part 316*a* is coupled to the door unit 31, the drawer coupling part 316*b* can support the drawer unit 32 by being inserted in the drawer unit 32. The drawer coupling part 316*b* may be coupled to the drawer unit 32 by a separate coupling member or may be coupled by a shape-fitting structure.

In order that the driving device 40 and the elevation device 80 can be connected when the door unit 31 and the drawer unit 32 are combined, a drawer opening 35 exposing a portion of the elevation device 80 may be formed on the front surface of the drawer unit 32.

Meanwhile, the door unit 31 is formed to be able to substantially open and close the storage space of the cabinet 10 and simultaneously form the front external appearance of the refrigerator 1.

The external appearance of the door unit 31 may be formed by an out case 31 that forms the front surface and a portion of the circumferential surface, a door liner 314 that forms the rear surface, and an upper deco 312 and a lower deco 313 that form the top surface and the bottom surface. The inside of the door unit 31 between the out case 311 and the door liner 314 may be filled with an insulator (not shown).

Hereafter, the door unit 31 constituting the door 30*b* and the driving assembly are described in more detail with reference to the drawings.

FIG. 5 is a rear perspective view of the door unit, FIG. 6 is a perspective view showing the state when an elevation device is connected to the driving device, FIGS. 7 and 8 are views showing the structure of a motor assembly according to an embodiment of the present invention, FIG. 9 is a view showing a transmission unit according to an embodiment of the present invention.

Referring to FIGS. 3 to 9, the front surface of the door unit 31 is formed by the out case 311 and rear surface may be formed by the door liner 314.

The driving device 40 for operating the elevation device 80 may be disposed in the door unit 31. The driving device 40 is disposed in the door unit 31, but is not embedded in the insulator and is disposed in a space formed by the door liner 314, and may be covered by the door cover 315 not to be exposed to the outside.

In detail, an insulator may be disposed between the out case 311 and the door liner 314 and insulates the inside of the storage space 12.

The driving device 40 may include a motor assembly 50 and a pair of transmission units 60 connected to the motor assembly 50. The elevation device 80 may be connected to each of the transmission units 60. That his, a pair of elevation devices 80 may be disposed and spaced apart from each other at the left and right side from the drawer unit 32.

The motor assembly 50 may include a driving motor 51 and a transmission unit that transmits power of the driving motor 51 to the transmission units 60.

The driving motor 51 provides power for moving up and down the elevation device 80 and can rotate forward and backward. Accordingly, when an elevation signal of the elevation device 80 is input, it is possible to provide power for moving up and down the elevation device 80 by rotating forward or backward. It can be stopped when a load of the driving motor 51 or a stop signal by sensing of a sensor is input.

The power transmission unit may include a first gear 52 connected to a shaft of the driving motor 51.

The power transmission unit may further include a second gear 53 engaged with the first gear 52 under the first gear 52. The second gear 53 may be a multistage gear having two parts having different diameters.

The part having a larger diameter of the second gear 53 may be engaged with the first gear 52.

The power transmission unit may further include a third gear 54 engaged with the part having a smaller diameter of the second gear 54.

The third gear 54 may be a multistage gear having two parts having different diameters. The part having a larger diameter of the third gear 54 may be engaged with the second gear 53.

The power transmission unit may further include a fourth gear 55 engaged with the third gear 54. The fourth gear 55 may be engaged with the part having a smaller diameter of the third gear 54.

The power transmission unit may further include a fifth gear 56 engaged with the fourth gear 55.

The fifth gear 56 may include a first part 56*a* and a second part 56*b* having a gear shape different from the first part 56*a*.

The first part 56*a*, for example, may be a spur gear and the second part 56*b* may be a bevel gear, a helical gear, or a worm gear.

The power transmission unit may further include a shaft driving gear 57 engaged with the second part 56*b*.

In the present embodiment, the first gear to fifth gear 52 to 56 may be referred to as transmission gears. In this configuration, the fifth gear 56 may be referred to as a final gear.

In the present embodiment, power of the driving motor 51 is transmitted to the shaft driving gear 57 through the first gear to fifth gear 52 to 56, but it should be noted that the number and the kinds of gears for transmitting the power of the diving motor 51 to the shaft driving gear 57 are not limited in the present embodiment.

However, the extension direction of the driving motor 51 and the extension direction of the shaft driving gear 57 may be different, and for example, may cross each other.

The shaft driving gear 57 may be connected a shaft sleeve 58. The shaft sleeve 58, for example, may be coupled through the shaft driving gear 57 to rotate with the shaft driving gear 57.

A shaft 59 may be coupled to both sides of the shaft sleeve 58.

The other components except for the shafts 59 of the power transmission unit may be accommodated in the housing 50*a*. The shafts 59 may protrude and extend from both sides of the housing 50*a* and may be connected with the transmission units 60.

The transmission unit 60 may include a first unit gear 62 connected with the shaft 59, a second unit gear 63 engaged with the first unit gear 62, and a unit housing 61 accommodating the first unit gear 62 and the second unit gear 63.

The first unit gear 62 and the second unit gear 63 can change a power transmission direction. To this end, the first unit gear 62 and the second unit gear 63 may be bevel gears, worm gears, or helical gears.

The axial line of the first unit gear 62, for example, may extend in the left-right direction (or a first direction) and the axial line of the second unit gear 63 may extend in the front-rear direction (or a second direction). That is, the axial line of the first unit gear 62 may cross the axial line of the second unit gear 63.

A connector 64 is connected to a shaft 63*a* of the second unit gear 63 and a screw 83 of the elevation device 80 to be described below may be coupled to the connector 64.

Accordingly, the screw 83 can rotate with the second unit gear 63 by the connector 64. The connector 64 may pass through the drawer opening 35. Accordingly, the driving force of the driving device 40 in the door unit 31 can be transmitted to the elevation device 80 in the drawer unit 32 by the connector 64.

FIG. 10 is a perspective view of an elevation device according to an embodiment of the present invention and FIG. 11 is a view showing the state when an upper frame of the elevation device of FIG. 10 is moved up at a predetermined height.

Referring to FIGS. 10 and 11, the elevation device 80 may include a lower frame 81, an upper frame 82 positioned over the lower frame 81, and a scissor assembly 87 connecting the lower frame 81 and the upper frame 82.

The lower frame 81, for example, may be formed in a rectangular parallelepiped shape with an open top. The lower side of the lower frame 81 may be open or closed.

The lower frame 81 may be elongated in the front-rear direction of the drawer unit 32.

The screw 83 may be accommodated in the lower frame 81. An end of the screw 83 may be rotatably supported on a first wall 81*c* of the lower frame 81 and the other end may be connected to the connector 64.

The connector 64 may be inserted inside the lower frame 81 and connected with the screw 83 through a second wall

81*d* disposed to face the first wall 81*c*. Alternatively, a portion of the screw 83 may be connected with the connector 64 through the second wall 81*d*.

The elevation device 80 may further include a movable unit 85 that can move along the screw 83. The screw 83 is coupled through the movable unit 85 and the movable unit 85 can move in the longitudinal direction of the screw 83 when the screw 83 is rotated. The longitudinal direction of the screw 83, for example, may be the front-rear direction of the drawer unit 32.

Guide protrusions 85*a* may be disposed at both sides of the movable unit 85. In the lower frame 81, first slots 81*a* in which the guide protrusions 85*a* are inserted may be formed at a pair of third walls 81*e* connecting the first wall 81*c* and the second wall 81*d*.

In order that the guide protrusions 85*a* can move in the first slots 81*a*, the first slots 81*a* may be elongated in the longitudinal direction of the screw 83.

The scissor assembly 87 may include a plurality of first rods 871 and 872 rotatably connected to the lower frame 81 and a plurality of second rods 874 and 875 rotatably supported by the upper frame 82.

The plurality of first rods 841 and 842 may be spaced apart in parallel from each other and connected to the lower frame 81.

The lower frame 81 may have a supporting shaft 84 rotatably supporting the plurality of first rods 841 and 842.

The supporting shaft 84 may be positioned adjacent to the second wall 81*d* of the lower frame 81 and both ends thereof may be fixed to the pair of third walls 81*e*.

The screw 83 may pass through the supporting shaft 84. In this configuration, the inner diameter of the supporting shaft 84 is larger than the outer diameter of the screw 83, so the supporting shaft 84 can keep fixed to the lower frame 81 regardless of rotation of the screw 83.

The plurality of first rods 841 and 842 may be rotatably connected to the supporting shaft 84 in a space of the lower frame 81.

For example, first ends of the plurality of first rods 841 and 842 may be rotatably connected to the supporting shaft 84.

The gap between the plurality of first rods 841 and 842 may be larger than the outer diameter of the screw 83. Accordingly, at least a portion of the screw 83 may be positioned between with the plurality of first rods 871 and 872 with the upper frame 82 moved down.

A movable shaft 876 may be connected to second ends positioned opposite the first ends of the plurality of first rods 871 and 872.

In this configuration, the movable shaft 876 may be movably coupled to the upper frame 82. A second slot 82*a* in which the movable shaft 876 is inserted may be formed at the upper frame 82.

For example, the movable shaft 876 may be accommodated in the second slot 82*a* through the plurality of first rods 871 and 872.

In order that the movable shaft 876 can move in the second slot 82*a*, the second slot 82*a* may be elongated in the longitudinal direction of the screw 83.

The plurality of second rods 874 and 875 may be spaced apart in parallel from each other and connected to the upper frame 82.

Though not limited, the plurality of first rods 871 and 872 may be positioned in the region between the plurality of second rods 874 and 875. Obviously, in the other way, the plurality of second rods 874 and 875 may be positioned in the region between the plurality of first rods 871 and 872.

First ends of the plurality of second rods 874 and 875 may be rotatably connected to the guide protrusion 85*a* of the movable unit 85.

For example, the movable shaft 874 may be accommodated in the first slots 81*a* through the plurality of second rods 874 and 875.

The gap between the plurality of second rods 874 and 875 may be larger than the outer diameter of the screw 83. Accordingly, at least a portion of the screw 83 may be positioned between with the plurality of second rods 874 and 875 with the upper frame 82 moved down.

A fixed shaft 877 may be connected to second ends positioned opposite the first ends of the plurality of second rods 874 and 875.

The fixed shaft 877 is fixed to the upper frame 82 and the second ends of the plurality of second rods 874 and 875 may be rotatably connected to the fixed shaft 877.

The plurality of first rods 871 and 872 and the plurality of second rods 874 and 875 may be connected by a connection shaft 878.

The connection shaft 878 may pass through the plurality of first rods 871 and 872 and the plurality of second rods 874 and 875, with the plurality of first rods 871 and 872 and the plurality of second rods 874 and 875 crossing each other.

When the upper frame 82 is moved to the lowermost position (the elevation device 80 is moved to the lowermost position), the upper frame 82 may be seated on the top surface of the lower frame 81. Accordingly, the height of the elevation device 80 can be minimum.

In order to prevent interference with the connection shaft 878 with the upper frame 82 seated on the top surface of the lower frame 81, the lower frame 81 and the upper frame 82 may respectively include accommodating grooves 81*b* and 82*b* in which the connection shaft 878 is accommodated.

FIG. 12 is an exploded perspective view of FIG. 4.

Referring to FIGS. 4 and 12, the drawer unit 32 may include a drawer main body 38 forming the entire shape of the drawer unit 32, the elevation device 80 disposed in the drawer main body 38 and being able to move up and down the container and food, and several plates 391, 392, and 395 forming the internal and external appearances of the drawer unit 32.

In detail, the drawer main body 38 may be made of a plastic material by injection molding and forms the entire shape of the drawer unit 32. The drawer main body 38 has a basket shape with an open top and has a receiving space therein for food. The rear surface of the drawer main body 38 may be an inclined surface 321, thereby being able to prevent interference with the machine room 3.

The door frames 316 may be mounted on both sides of the drawer unit 32. The door frames 316 may be coupled to frame mounts 383 on both sides of the bottom surface or at the lower portions of both left and right sides of the drawer unit 32. When the door frames 316 are coupled to the drawer unit 32, the drawer unit 32 and the door unit 31 are integrally combined to be able to be drawn in and out together.

The door frame 316 and the drawer unit 32 may be coupled to each other by a coupling structure using a separate coupling member or a shape-fitting structure between the door frame 316 and the drawer unit 32.

The drawing racks 34 may be disposed on both left and right sides of the bottom surface of the drawer unit 32. The drawer unit 32 can be drawn in and out in the front-rear direction by the drawing racks 34. In detail, when the drawer unit 32 is mounted on the cabinet 10, at least a portion thereof is positioned in the storage space. The drawing racks 34 may be coupled to the pinion gears 141 disposed on the floor surface of the storage space. Accordingly, when the drawing motor 141 is driven, the pinion gears 141 are rotated, so the drawing racks 34 can be moved and the door 30 can be drawn in and out.

Obviously, the door 30 may not be automatically drawn in and out and a user can draw the door 30 in and out by pushing and pulling it, and in this case, the drawing racks 34 are omitted and drawing-in and out may be guided only by the drawing rails 33.

The rail mounts 382 where the drawing rails 33 for guiding the drawer main body 38 being drawn in and out may be formed at the lower portions of both sides of the drawer main body 38. The rail mounts 382 extend from the front end to the rear end and may have a space therein in which the drawing rails 33 can be accommodated.

The drawing rails 33, which are multi-stage stretching rails, may have an end fixed in the storage space in the cabinet 10 and the other end fixed to the rail mount 382 such that the door 30 can be more stably drawn in and out.

The several plates 391, 392, 395 made of a metal material having a plate shape such as stainless steel and forming at least a portion of the internal and external appearances of the drawer main body 38.

In detail, outer side plates 391 may be disposed on both left and right outer sides of the drawer main body 38. The outer side plates 391 are mounted on both left and right sides of the drawer main body 38, thereby forming the external appearance of the both sides, and particularly, being able to prevent exposure of components such as the door frames 316 and the drawing rails 33 mounted on both sides of the drawer main body 38.

Several reinforcing ribs 384 may be formed on both left and right outer sides of the drawer main body 38 to cross each other transversely and longitudinally. For example, the several reinforcing ribs 384 may be formed in a lattice shape.

The reinforcing ribs 384 can enable the drawer main body 38 to more firmly maintain the shape against the weight of the door increased due to the driving device 40 and the elevation device 80 by increasing the strength of the drawer main body 38 itself.

The reinforcing ribs 384 can be in contact with the outer side plates 391 mounted on both sides, thereby enabling the external appearance of the drawer unit 32 to be firmly maintained.

Inner side plates 392 may be disposed on both left and right inner sides of the drawer main body 38. The inner side plates 392 are mounted on both left and right sides of the drawer main body 38 and may form both left and right inner sides.

The inner plate 395 may include a front surface portion 395*a*, a bottom surface portion 395*b*, and a rear surface portion 395*c* that have sizes and shapes corresponding to those of the inner front surface, bottom surface, and rear surface of the drawer main body 38.

The inner plate 395 may be formed by bending a plate-shaped stainless material to be able to form the other inner sides except for the left and right sides of the drawer main body 38. Both left and right side ends of the inner plate 395 may be in contact with the inner side plates 392. Obviously, the front surface portion 395*a*, the bottom surface portion 395*b*, and the rear surface portion 395*c* that constitute the inner plate 395 may be separately formed and then coupled or bonded to each other.

By the inner side plates 392 and the inner plate 395, all of the inner sides of the drawer main body 38 can be formed and the inner sides of the drawer main body 38 can provide a metallic texture.

Accordingly, the entire receiving space in the drawer unit 32 can have a metallic texture, the food received therein can be uniformly kept cool throughout the entire area, and excellent cooling performance and storing performance can be provided to a user.

The drawer cover 37 may include a cover front surface portion 371 dividing the inside of the drawer main body 38 into the front space S1 and the rear space S2, and a cover top surface portion 372 bending from the upper end of the cover front surface portion 371 and covering the top surface of the rear space S2.

That is, when the drawer cover 37 is mounted, only the front space S1 in which the elevation device 80 is disposed may be exposed in the drawer main body 38 and the rear space S2 may be covered by the drawer cover 37.

On the other hand, the elevation device 80 may be disposed in the drawer main body 38. The elevation device 80 has a structure connected with the driving device 40 to be able to move up and down, and both left and right sides may be uniformly moved up and down.

In order to couple the elevation device 80 and the driving device 40, a drawer opening 35 is formed at the lower portion of the front surface of the drawer 32.

Meanwhile, the elevation device 80 may be configured in a scissors type such that it is folded when it moves down, and it is unfolded when it is moved up so that the container or food seated on the top surface thereof is moved up and down.

The elevation device 80 may further include a support plate 89 and the support plate 81 can provide a seating surface for the container 36 or a surface on which food is seated.

For example, the support plate 81 may be seated on the upper sides of the pair of upper frames 82 in the drawer unit 32. Accordingly, exposure to the outside of the elevation device 80 can be prevented by the support plate 81.

Meanwhile, the height of the drawer opening 35 may be at a position lower than the upper end of the elevation device 80, that is, the top surface of the support plate 81. Accordingly, when the elevation device 80 is mounted, it is possible to prevent the drawer opening 35 from being shown inside the drawer unit 32 in any states.

In addition, the support plate 81 has a size and a shape corresponding to the front space, thereby being able to prevent dirt from permeating into the elevation device 80 disposed under the front space S1 and to preclude a safety accident by blocking approach to the elevation device 80.

Hereafter, the state when the door 30*b* of the refrigerator 1 having the above-mentioned structure according to an embodiment of the present invention is described in more detail with reference to the drawings.

FIG. 13 is a perspective view showing the state when the lower drawer door is closed.

Referring to FIG. 13, when food is kept in the refrigerator 1, both of the rotation door 20 and the door 30 are closed. In this state, a user can draw out the door 30 and put food inside.

A plurality of doors 30 may be provided up and down and can be drawn out and opened by manipulation of a user.

The manipulation of the user may be performed by touching the manipulation part 301 disposed on the front surface of the rotation door 20 or the door 30, and opening manipulation by the manipulation device 302 disposed at the lower end of the door 30 may be possible.

The manipulation part 301 and the manipulation device 302 may be configured to respectively individually draw in and out the door 30 and move up and down the elevation device 80. Obviously, a user can also open the door 30 with the handle of the door 30 held by hand.

It is exemplified hereafter that a lower drawer door 30*b* of the doors 30 disposed up and down is opened and moved up and down, but both of the upper and lower doors 30 may be drawn in and out and moved up and down in the same manner.

FIG. 14 is a perspective view showing the state when a lower drawer door is fully open and FIG. 15 is a cross-sectional view of the drawer door in the state when the container of the drawer door is fully moved down.

Referring to FIGS. 14 and 15, when a user draws out the lower drawer door 30*b*, the lower drawer door 30*b* is drawn forward. The lower drawer door 30*b* can be drawn out while the drawing rails 33 are stretched.

Meanwhile, the lower drawer door 30*b* may be configured not in the manner in which a user opens the lower drawer door 30*b* by pulling it in person, but to be drawn out by driving of the drawing motor 14.

The drawing racks 34 disposed on the floor surface of the lower drawer door 30*b* may be coupled to the pinion gears 141 that are rotated when the drawing motor 14 disposed on the cabinet 10 is driven, and accordingly, the lower drawer door 30*b* is drawn in and out by driving of the drawing motor 14.

The lower drawer door 30*b* can be drawn out up to a distance such that at least the front space S1 in the drawer unit 32 can be fully exposed to the outside. Accordingly, in this state, when the elevation device 80 is moved up and down, the container or food is not interfered with by the doors 20 and 30 or the cabinet 10.

In this case, the drawing-in and out distance of the lower drawer door 30*b* may be determined by a drawing sensing device 15 disposed on the cabinet 10 and/or the lower drawer door 30*b*.

The drawing sensing device 15 may be configured as a sensor that senses a magnet 389 to be able to sense the state when the lower drawer door 30*b* is fully drawn out or closed.

For example, as shown in the figures, the magnet 389 may be disposed on the floor of the drawer unit 32 and the sensor may be disposed on the cabinet 10. The drawing sensing device 15 may be disposed at positions corresponding to the position of the magnet 389 when the lower drawer door 30*b* is closed and corresponding to the position of the magnet 389 when the lower drawer door 30*b* is fully drawn out. Accordingly, it is possible to determine the drawing-in and out state of the lower drawer door 30*b* using the drawing sensing device 15.

If necessary, switches may be disposed at positions where the lower drawer door 30*b* is fully drawn in and drawn out, thereby being able to sense drawing-in and out of the lower drawer door 30*b*. Further, it may be possible to sense drawing-in and out of the lower drawer door 30*b* using a sensor that counts the number of revolutions of the drawing motor 14 or measures the distance between the rear surface of the door unit 31 and the front end of the cabinet 10.

When the lower drawer door 30*b* is fully drawn out, the driving motor 51 is driven and the elevation device 80 can be operated. The elevation device 80 may be configured to operate in a situation in which the lower drawer door 30*b* is sufficiently drawn out and food or the container 36 seated on the elevation device 80 can be safely moved up and down.

That is, when the lower drawer door 30*b* is drawn out and the front space S1 is fully exposed to the outside, the elevation device 80 is operated such that the container 36 or stored food seated on the elevation device 80 is not interfered with by other doors 20 and 30 or the cabinet 10.

The state when the lower drawer door 30*b* is drawn out is described in more detail. When the lower drawer door 30*b* is drawn out to be moved up, the front space S1 has to be fully drawn out of the lower storage space 12.

In particular, the rear end L1 of the front space S1 has to be drawn out further than the cabinet 10 or the front end L2 of the upper door 20. Further, in order to prevent interference when the elevation device 80 is moved up and down, the rear end L1 has to be able to be positioned further forward than at least the cabinet 10 or the front end L2 of the upper door 20.

When the elevation device 80 is drawn out to be driven, the drawer unit 32 may be drawn out not entirely and fully, but only to a position for avoiding interference when the elevation device 80 is moved up and down, as shown in FIG. 14. In this case, at least a portion of the rear space S2 of the drawer unit 32 is positioned in the lower storage space 12. That is, the rear end L3 of the drawer unit 32 is positioned at least in the lower storage space 12.

Accordingly, even in a state when not only the weight of the lower drawer door 30*b* including the driving device 40 and the elevation device 80, but the weight of the received objects are added, it is possible to secure stable drawing-in and out and up-down movement without the drawing rails 33 or the lower drawer door 30*b* itself from sinking or being damaged.

The elevation device 80 may start to be moved up after full drawing-out of the lower drawer door 30*b* is determined. In order to secure safety of a user and prevent an injury of the stored food, the elevation device 80 may be configured to start to be operated when a set time passes after drawing-out of the lower drawer door 30*b* is determined.

Obviously, after the lower drawer door 30*b* is drawn out, a user may directly input operation of the elevation device 80 by manipulating the manipulation part 301. That is, it is possible to manipulate the manipulation part 301 in order to draw out the door 30 and it is also possible to manipulate again the manipulation part 301 in order to operate the elevation device 80.

A user may manually draw out the lower drawer door 30*b* and then manipulate the manipulation part 301 to operate the elevation device 80.

Meanwhile, until the lower drawer door 30*b* is fully drawn out, as shown in FIG. 14, the driving device 40 and the elevation device 80 are not operated and the elevation device 80 is maintained at the lowest position.

FIG. 16 is a cross-sectional view of the drawer door in the state when the container of the lower drawer door is fully moved up.

As shown in FIG. 16, when the lower drawer door 30*b* has been drawn out and an operation signal of the driving device 40 is input, the driving device 40 is operated and the elevation device 80 is moved up, whereby the state shown in FIG. 16 is obtained.

In the present embodiment, moving-up of the elevation device 80 means that the upper frame 82 is moved up by the scissor assemblies 87 and moving-down of the elevation device 80 means that the upper frame 82 is moved down by the scissor assemblies 87.

Since the driving device 40 is connected with the elevation device 80, it is a state in which power can be transmitted to the elevation device 80. Upon starting to operate the driving device 40, power is transmitted to the elevation device 80 and the elevation device 80 starts to be moved up.

Meanwhile, the elevation device 80 is continuously moved up, and is stopped when it is moved up to a position that is high enough to easily approach food or the container 36 seated on the elevation device 80, as shown in FIG. 16. In this state, a user can easily pick up the food or the container 36 even without excessively bending over.

When an elevation completion signal of the elevation device 80 is input, driving of the driving motor 51 is stopped. To this end, a height sensing device (not shown) that can sense the position of the elevation device 80 may be provided.

The height sensing device (not shown) is disposed on the door unit 31 and may be disposed at a position corresponding to the maximum height of the elevation device 80 and a position corresponding to the minimum height of the elevation device 80.

The height sensing device may be configured as a sensor that senses a magnet and can determine whether the elevation device 80 has finished being moved up by sensing the magnet disposed on the elevation device 80. The height sensing device may be configured as a switch structure such that a switch is turned on when the elevation device 80 is maximally moved up.

Alternatively, the height sensing device may sense the moved-down position of the movable unit 56. It may be possible to determine whether the elevation device 80 has been maximally moved up on the basis of a change in load that is applied to the driving motor 64.

Meanwhile, when the elevation device 80 has been maximally moved up, the driving motor 51 is stopped. In this state, the elevation device 80 is positioned in the drawer unit 32, but the food or the container 36 seated on the elevation device 80 can be positioned higher than the open top surface of the drawer unit 32, so a user can easily approach it.

In particular, since a user does not need to excessively bend over to pick up the container 36, more safe and convenient work is possible.

The state in which the elevation device 80 has been maximally moved up is described in more detail. The elevation device 80 is moved up by driving of the driving device 40 and is positioned at least lower than the upper end of the drawer unit 32.

The container 36 is seated on the driving device 80, and as for the container 36, the upper end H1 of the container 36 may be moved up higher than the upper end H2 of the lower storage space 12. The height in this case is a height that enables a user to stretch hands and pick up the container 36 without bending over, which may be a height that is the most suitable for use.

That is, the driving device 40 has a structure that is moved up in the drawer unit 32, but when the container 36 is seated on the elevation device 80, the container 36 can be positioned at a height that a user can easily approach.

After a user finishes putting food in the refrigerator, the user can move down the elevation device 80 by manipulating the manipulation part 301. Moving-down of the elevation device 80 can be achieved by backward rotation of the driving motor 51 and may be slowly performed through a reverse process of the process described above.

When the elevation device 80 finishes being moved down, the state shown in FIG. 14 is made, and completion of moving-down of the elevation device 80 may be made by the height sensing device. The height sensing device may be further provided at a corresponding position to be able to sense the magnet disposed on the elevation device 80 when the elevation device 80 is positioned at the lowermost position. Accordingly, when completion of moving-down of the elevation device 80 is sensed, the driving device 40 is stopped.

After the driving motor 51 is stopped, the lower drawer door 30*b* can be drawn in. In this case, the lower drawer door 30*b* may be closed by manipulation of the user or may be closed by driving of the drawing. When the lower drawer door 30*b* is fully closed, the state shown in FIG. 13 may be obtained.

FIG. 17 is a view showing the state when an upper frame of the elevation device is fully moved up.

Referring to FIGS. 7, 10, and 17, when the driving motor 51 is rotated in a direction, the power of the driving motor 51 is transmitted to shaft driving gear 57 through the a plurality of gears 52, 53, 54, 55, and 56.

The shafts 59 at both sides of the shaft driving gear 57 are rotated by rotation of the shaft driving gear 57. The power of the driving motor 51 can be uniformly transmitted to the pair of elevation devices 80 rotation of the shafts 59 at both sides.

The first unit gear 62 is rotated by rotation of the shafts 59 and the power transmission direction is changed by the second unit gear 63 engaged with the first unit gear 62.

Torque is transmitted through the connector 64 connected to the second unit gear 63, so the screw 83 is rotated.

When the elevation devices 80 are positioned at the lowermost position, the movable unit 85 is positioned farthest from the connector 64. That is, the movable unit 85 is positioned such that the lower frame 81 is in contact with or adjacent to the first wall 81*c*.

When the screw 83 is rotated, the movable unit 85 moves toward the connector 64 or the second wall 81*d* of the lower frame 81.

The plurality of first rods 871 and 872 and the plurality of second rods 874 and 875 are moved up, and accordingly, the upper frame 82 can be moved up.

In the present embodiment, the scissors assemblies 87 can be unfolded by rotation of the screw 83.

As a result, as the scissor assembly 87 is folded, the upper frame 82 is moved up, the food or the container 36 seated on the elevation device 80 is moved up, and accordingly, the elevation device 80 is moved up to the maximum height, as shown in FIG. 16.

In this state, the driving device 40 is stopped, and when a user inputs manipulation to move down the elevation device 80 after putting food into the refrigerator, the driving motor 51 is rotated backward. The elevation device 80 is moved down by a reverse process of the process described above, and the state shown in FIG. 15 can be obtained.

Meanwhile, the present invention may be achieved in various embodiments other than the embodiment described above.

Hereafter, other embodiments of the present invention are described with reference to the drawings. In other embodiments of the present invention, the same components as those in the previous embodiment are given the same reference numerals and are not described and shown in detail.

FIG. 18 is a perspective view of a refrigerator according to another embodiment of the present invention.

Referring to FIG. 18, a refrigerator 1*a* according to another embodiment of the present invention may include a cabinet 10 having a storage space partitioned up and down, and a door configured to open and close the storage space.

The door may include a rotation door 20 disposed at the upper portion of the front surface of the cabinet 10 to open and close the upper storage space and a door 30 disposed at the lower portion of the front surface of the cabinet 10 to open and close the lower storage space.

The door 30 can be drawn in and out forward and rearward, as in the previous embodiment, and may have a structure in which when the door 30 is drawn out, a container and food in the drawer unit 32 can be moved up and down by operations of the driving device 40 and the elevation device 80 in the door 30.

The elevation device 80 may be disposed in the area of a front space in the drawer unit 32, and accordingly, food can be moved up and down by the elevation device 80 in the area of the front space of the entire area of the drawer unit 32.

A manipulation part 301 or a manipulation device 302 may be disposed at a side of the door unit 31, and the driving device 40 may be disposed in the door unit 31. By manipulation of the manipulation part 301 or a manipulation device 302, the drawer door 30 can be drawn in and out and/or the elevation device 80 can be moved up and down.

The elevation device 80 is disposed at the drawer unit 32 and can be moved up and down by the driving device. The configuration of the drawer door 30 and the configuration of the driving device 40 and the elevation device 80 are the same as those in the previous embodiment, so detailed description is omitted.

A plurality of containers 361 may be disposed on the elevation device 80. The containers 361 may be sealed containers such as a Kimchi container, and several containers can be seated on the elevation device 80. The containers 361 may be moved up and down together when the elevation device 80 is moved up and down.

Accordingly, at least a portion of the container 361 may protrude upward from the drawer unit 32 when it is moved up, and a user easily picks up the container 361.

Meanwhile, even though the drawer door 32 is drawn out, the elevation device 80 may interfere with the rotation door 20 with the rotation door 20 open, so the elevation device 80 is configured to be able to move up with the rotation door 20 closed. To this end, a door switch for sensing opening and closing of the rotation door 20 may be further provided.

FIG. 19 is a perspective view of a refrigerator according to another embodiment of the present invention.

Referring to FIG. 19, a refrigerator 1*b* according to another embodiment of the present invention may include a cabinet 10 having a storage space, and a door configured to open and close an open front surface of the cabinet 10.

The door forms the external appearance of the front surface of the refrigerator 1 when it is closed, and may be configured as a drawer door 30 that is drawn forward and rearward. Several drawer doors 30 may be continuously disposed up and down. Each of the drawer doors 30 may be independently drawn in and out by manipulation of a user, and a driving device 40 and an elevation device 80 may be disposed in the drawer door 30.

The driving device 40 may be disposed at the door unit 31 and the elevation device 80 may be disposed in the drawer unit 32. When the door unit 31 and the drawer unit 32 are combined, the driving device 40 and the elevation device 80 are connected to each other, whereby power can be transmitted.

Further, the elevation device 80 may be disposed in a front space S1 of the entire storage space of the drawer unit 32.

The drawer door 30 and the elevation device 80 may be individually drawn in and out and moved up and down, respectively. Further, moving-up of the elevation device 80 after the drawer door 30 is drawn out, and drawing-in of the drawer door 30 after the elevation device 80 is moved down may be continuously performed.

When a plurality of drawer doors 30 is disposed up and down, the elevation device 80 in a drawer door 30 disposed at a relatively low position is not moved up with a drawer door 30 disposed at a relatively high position drawn out, whereby it is possible to prevent stored food and a container from interfering with the drawer door 30 drawn out at a relatively high position.

Although an example in which the elevation device 80 has been moved up with the drawer door 30 at the lowermost position drawn out is shown in FIG. 19, all of the drawer doors 30 disposed at higher positions can be configured such that they are drawn out and then the elevation devices 80 therein can be moved up and down.

Obviously, if the heights of the drawer doors 30 disposed at higher positions are sufficiently large, only the drawer door 30 at the lowermost position or the drawer doors 30 at relatively higher positions may have a structure that can be moved up and down.

FIG. 20 is a perspective view of a refrigerator according to another embodiment of the present invention.

Referring to FIG. 20, a refrigerator 1*c* according to another embodiment of the present invention may include a cabinet 10 having a storage space, and a door configured to open and close an open front surface of the cabinet 10.

The storage device in the cabinet 10 may be partitioned up and down, and if necessary, the upper and lower storage device may be partitioned again to the left and right.

The door may be composed of a rotation door 20 disposed at the upper portion the cabinet 10 and rotatably mounted to open and close the upper storage space and a door 30 disposed at the lower portion of the cabinet 10 and mounted to be able to be drawn in and out to open and close the lower storage space.

The lower space of the cabinet 10 may be partitioned left and right and the drawer door 30 may be provided in pairs to be able to open and close the partitioned lower spaces, respectively. The drawer door 30 is disposed in pairs in parallel at both left and right sides, and a driving device 40 and an elevation device 80 may be disposed in the drawer door 30.

The driving device 40 may be disposed at the door unit 31 and the elevation device 80 may be disposed in the drawer unit 32. When the door unit 31 and the drawer unit 32 are combined, the driving device 40 and the elevation device 80 are connected to each other, whereby power can be transmitted. Further, the elevation device 80 may be disposed in a front space S1 of the entire storage space of the drawer unit 32.

The drawer door 30 has the same configuration as the previous embodiments and may be drawn in and out by manipulation of a user. Further, the elevation device 80 is moved up when the drawer door 30 is drawn out, so a user can more conveniently approach food or containers in the drawer door 30.

What is claimed is:

1. A refrigerator comprising:

a cabinet having a storage space;

a door including a door unit exposed outside the cabinet to open or close the storage space and a drawer unit extended backward from the rear side of the door unit, the drawer unit capable of disposed in the cabinet;

a driving device disposed at the door unit and including a driving motor to provide power; and an elevation device disposed at the drawer unit, connected with the driving device, to move up or down, wherein the elevation device includes:

a lower frame;

an upper frame positioned over the lower frame;

a scissor assembly to connect the lower frame and the upper frame; and a screw rotatably supported at the lower frame, rotated by driving force transmitted from the driving device disposed at the door unit, and connected with the scissor assembly.

2. The refrigerator of claim 1, wherein the driving device includes:

a motor assembly including the driving motor and a power transmission unit to transmit power of the driving motor; and a transmission unit to transmit power of the motor assembly to the elevation device.

3. The refrigerator of claim 2, wherein a pair of transmission units are disposed at respective sides of the motor assembly, and the elevation device is connected to each of the pair of transmission units.

4. The refrigerator of claim 3, wherein the elevation device further includes a supporting plate seated on a plurality of upper frames.

5. A refrigerator comprising:

a cabinet having a storage space;

a door including a door unit to open or close the storage space and a drawer unit to provide a receiving space;

a driving device disposed at the door unit and including a driving motor to provide power; and an elevation device disposed at the drawer unit, connected with the driving device, to move up or down, wherein the elevation device includes:

a lower frame;

an upper frame positioned over the lower frame;

a scissor assembly to connect the lower frame and the upper frame; and a screw rotatably supported at the lower frame, rotated by driving force transmitted from the driving device disposed at the door unit, and connected with the scissor assembly, wherein the driving device includes a motor assembly including the driving motor and a power transmission unit to transmit power of the driving motor;

wherein the power transmission unit includes:

a plurality of transmission gears to transmit the power of the driving motor;

a shaft driving gear connected to a final gear of the plurality of transmission gears; and a plurality of shafts connected to the shaft driving gear and extending from respective sides of the shaft driving gear.

6. The refrigerator of claim 5, wherein an extension direction of an axial line of the driving motor crosses with an extension direction of an axial line of the shaft driving gear.

7. The refrigerator of claim 5, wherein the transmission unit includes:

a first gear connected with the shaft; and a second gear connected with the first gear, and an axial line of the first gear crosses with an axial line of the second gear.

8. The refrigerator of claim 7, wherein the transmission unit further includes a connector to connect the second gear and the screw.

9. The refrigerator of claim 8, wherein the drawer unit includes a drawer opening to access the connector.

10. A refrigerator comprising:

a cabinet having a storage space;

a door including a door unit to open or close the storage space and a drawer unit to provide a receiving space;

a driving device disposed at the door unit and including a driving motor to provide power, and an elevation device disposed at the drawer unit, connected with the driving device, to move up or down, wherein the elevation device includes:

a lower frame;

an upper frame positioned over the lower frame;

a scissor assembly to connect the lower frame and the upper frame; and a screw rotatably supported at the lower frame, rotated by driving force transmitted from the driving device disposed at the door unit, and connected with the scissor assembly, wherein the scissor assembly includes:

a plurality of first rods; and a plurality of second rods disposed corresponding to the plurality of first rods, and an end of the screw is rotatably supported at a first wall of the lower frame, and another end of the screw is connected to the driving device through a second wall positioned opposite to the first wall.

11. The refrigerator of claim 10, wherein the elevation device further includes a movable unit movably connected to the screw, and first ends of the plurality of second rods are rotatably connected to the movable unit.

12. The refrigerator of claim 11, wherein second ends of the plurality of second rods are rotatably connected to the upper frame.

13. The refrigerator of claim 11, wherein guide protrusions are disposed at both sides of the movable unit, the guide protrusions protrude from the plurality of second rods, respectively, and first slots in which the guide protrusions are inserted are formed at a pair of third walls, respectively, the pair of third walls connecting respective sides of the first wall and the second wall of the lower frame.

14. The refrigerator of claim 13, wherein the first slots are elongated in a longitudinal direction of the screw.

15. The refrigerator of claim 10, wherein the elevation device further includes a supporting shaft positioned adjacent to the second wall and rotatably supporting first ends of the plurality of first rods.

16. The refrigerator of claim 15, wherein the screw passes through the supporting shaft.

17. The refrigerator of claim 10, wherein the elevation device further includes a movable shaft rotatably supporting second ends of the plurality of first rods and movably connected to the upper frame.

18. The refrigerator of claim 17, wherein the upper frame includes a second slot in which the movable shaft is inserted and that extends in a longitudinal direction of the screw.

19. The refrigerator of claim 10, wherein the upper frame is seated on a top surface of the lower frame when the upper frame is moved to a lowermost position.

20. The refrigerator of claim 19, wherein the scissor assembly includes a connection shaft to connect the plurality of first rods and the plurality of second rods, and an accommodating groove formed at each of the upper frame and the lower frame in which the connection shaft is accommodated in a state in which the upper frame is seated on the top surface of the lower frame.

* * * * *